US011398124B2

(12) United States Patent
Iwai et al.

(10) Patent No.: US 11,398,124 B2
(45) Date of Patent: Jul. 26, 2022

(54) MONEY HANDLING SYSTEM, MONEY HANDLING MACHINE, AND MONEY HANDLING METHOD

(71) Applicant: GLORY LTD., Himeji (JP)

(72) Inventors: Yutatsu Iwai, Himeji (JP); Tadashi Urimoto, Himeji (JP)

(73) Assignee: GLORY LTD., Himeji (JP)

( * ) Notice: Subject to any disclaimer, the term of this patent is extended or adjusted under 35 U.S.C. 154(b) by 231 days.

(21) Appl. No.: 16/623,515

(22) PCT Filed: May 25, 2018

(86) PCT No.: PCT/JP2018/020219
§ 371 (c)(1),
(2) Date: Dec. 17, 2019

(87) PCT Pub. No.: WO2018/235525
PCT Pub. Date: Dec. 27, 2018

(65) Prior Publication Data

US 2021/0150842 A1 May 20, 2021

(30) Foreign Application Priority Data

Jun. 22, 2017 (JP) ..... JP2017-122356
Jun. 26, 2017 (JP) ..... JP2017-124436

(51) Int. Cl.
*G07D 11/125* (2019.01)
*G07D 11/25* (2019.01)
(Continued)

(52) U.S. Cl.
CPC ..... *G07D 11/25* (2019.01); *G07D 1/06* (2013.01); *G07D 11/125* (2019.01); *G07D 11/18* (2019.01);
(Continued)

(58) Field of Classification Search
CPC ..... G07D 1/06; G07D 11/00; G07D 11/0087; G07D 11/009; G07D 11/0093;
(Continued)

(56) References Cited

U.S. PATENT DOCUMENTS 6,648,220 B1 * 11/2003 Junkins ..... G06Q 30/04 235/379
6,845,905 B2 * 1/2005 Blad ..... G06Q 20/1085 235/375
(Continued)

FOREIGN PATENT DOCUMENTS

JP 2002-190051 A 7/2002
JP 2006-331225 A 12/2006
(Continued)

OTHER PUBLICATIONS

Japanese Office Action and English translation, Application No. 2017-122356, dated Apr. 9, 2021, 8 pages.
(Continued)

*Primary Examiner* — Thien M Le
*Assistant Examiner* — April A Taylor
(74) *Attorney, Agent, or Firm* — Foley & Lardner LLP

(57) ABSTRACT

In a money handling system (10), a storage cassette (40) is detachably mounted to each of a money change machine (20) and a money depositing/dispensing machine (30) (money handling machine). A determination unit (51) is provided for determining whether or not money has been sent into the money depositing/dispensing machine (30) from all the storage cassettes (40) to which money has been sent from the money change machine (20) when a plurality of the storage cassettes (40) are used in a collection process.

10 Claims, 16 Drawing Sheets

(51) Int. Cl.

| | |
|---|---|
| ***G07D 11/18*** | (2019.01) |
| ***G07D 1/06*** | (2006.01) |
| *G07D 7/181* | (2016.01) |
| *G07D 11/245* | (2019.01) |
| *G07D 11/14* | (2019.01) |
| *G07D 9/00* | (2006.01) |

(52) U.S. Cl.
CPC ..... *G07D 7/181* (2017.05); *G07D 9/006* (2013.01); *G07D 11/14* (2019.01); *G07D 11/245* (2019.01); *G07D 2201/00* (2013.01); *G07D 2205/00* (2013.01); *G07D 2207/00* (2013.01); *G07D 2211/00* (2013.01)

(58) Field of Classification Search
CPC .. G07D 11/0096; G07D 11/12; G07D 11/125; G07D 11/24; G07D 11/245; G07D 11/30; G07D 11/36; G07D 2211/00; G07D 11/13; G07D 11/20; G07D 11/23; G07D 11/235; G07D 11/25; G07D 11/32; G07D 11/34; G07D 11/50
See application file for complete search history.

(56) References Cited

U.S. PATENT DOCUMENTS

| | | | | |
|---|---|---|---|---|
| 2002/0079361 | A1 | 6/2002 | Kosugi | |
| 2018/0350183 | A1* | 12/2018 | Sato ..... | G07D 11/34 |

FOREIGN PATENT DOCUMENTS

| | | | |
|---|---|---|---|
| JP | 2007-034522 | A | 2/2007 |
| JP | 2012-008646 | A | 1/2012 |
| JP | 2012-168658 | A | 9/2012 |
| JP | 2015-207311 | A | 11/2015 |
| JP | 2017-97403 | A | 6/2017 |
| WO | WO-2011/145691 | A1 | 11/2011 |

OTHER PUBLICATIONS

Japanese Office Action and English translation, Application No. 2017-122356, dated Jul. 2, 2021, 4 pages.
Extended European Search Report, Application No. 18821138.7, dated Feb. 26, 2021, 8 pages.

* cited by examiner

| USAGE OF STORAGE CASSETTE | OPERATION PERFORMED WHEN STORAGE CASSETTE IS MOUNTED TO CASSETTE MOUNTING UNIT |
|---|---|
| COLLECTION | SEND BANKNOTES AS PROCEEDS FROM SALES FROM STORAGE CASSETTE TO STORAGE/FEEDING UNIT |
| REPLENISHMENT | SEND BANKNOTES AS CHANGE FUND FROM STORAGE/ FEEDING UNIT TO STORAGE CASSETTE |
| REPLENISHMENT COLLECTION | • WHEN BANKNOTES ARE STORED IN STORAGE CASSETTE<br>SEND BANKNOTES AS PROCEEDS FROM SALES FROM STORAGE CASSETTE TO STORAGE/FEEDING UNIT<br>• WHEN NO BANKNOTES ARE STORED IN STORAGE CASSETTE<br>SEND BANKNOTES AS CHANGE FUND FROM STORAGE/FEEDING UNIT TO STORAGE CASSETTE |
| STORAGE | • WHEN BANKNOTES ARE STORED IN STORAGE CASSETTE<br>SEND BANKNOTES FROM STORAGE CASSETTE TO STORAGE/ FEEDING UNIT<br>• WHEN NO BANKNOTES ARE STORED IN STORAGE CASSETTE<br>SEND BANKNOTES FROM STORAGE/FEEDING UNIT TO STORAGE CASSETTE |

FIG. 6

| | |
|---|---|
| IDENTIFICATION NUMBER OF STORAGE CASSETTE | 001 |
| THE LAST CASSETTE? (0=NOT THE LAST CASSETTE 1=THE LAST CASSETTE) | 1 |
| NUMBER INDICATING ORDER IN WHICH THE STORAGE CASSETTE HAS BEEN USED IN COLLECTION PROCESS | 5 |

| IDENTIFICATION NUMBER OF STORAGE CASSETTE | USAGE |
|---|---|
| 001 | REPLENISHMENT |
| 002 | REPLENISHMENT |
| 003 | REPLENISHMENT |
| 004 | STORAGE |
| 005 | COLLECTION |
| 006 | COLLECTION |
| ⋮ | ⋮ |

FIG. 14

INFORMATION ON STORAGE CASSETTE USED IN COLLECTION PROCESS

| ORDER | IDENTIFICATION NUMBER OF STORAGE CASSETTE |
|---|---|
| 1 | 008 |
| 2 | 002 |
| 3 | 001 |
| 4 | 003 |
| 5 | 005 |

MONEY HANDLING SYSTEM, MONEY HANDLING MACHINE, AND MONEY HANDLING METHOD

TECHNICAL FIELD

The present invention relates to a money handling system that handles money such as banknotes and coins, a money handling machine and a money change machine in the money handling system, and a money handling method performed by the money handling system.

BACKGROUND ART

In stores of commercial facilities such as supermarkets and convenience stores, a money change machine is installed together with a POS register at a settlement place in a front office region where store shelves are arranged, and a money depositing/dispensing machine such as a cashier machine is installed in a back office region which customers are not allowed to enter. The money change machine installed at the settlement place in the front office region can deposit money delivered as proceeds from sales for a commodity from a customer to a clerk, and can dispense money as change. Furthermore, the money depositing/dispensing machine such as a cashier machine installed in the back office region deposits money, as proceeds from sales, collected from the money change machine, and dispenses money as change fund with which the money change machine is to be replenished. As such a money handling system in which a money change machine and a money depositing/dispensing machine are combined with each other, for example, the money handling system disclosed in Japanese Laid-Open Patent Publication No. 2015-207311 (JP2015-207311A) and the like is conventionally known.

In the conventional money handling system disclosed in Japanese Laid-Open Patent Publication No. 2015-207311 and the like, banknotes are delivered between the money change machine and the money depositing/dispensing machine by using a storage cassette capable of storing banknotes and feeding out the stored banknotes. More specifically, the storage cassette is detachably mounted to each of the money change machine and the money depositing/dispensing machine, and only when the storage cassette is mounted to the money change machine or the money depositing/dispensing machine, banknotes can be fed out from the storage cassette. This can prevent a malicious operator from taking out a part of banknotes when the banknotes are delivered between the money change machine and the money depositing/dispensing machine, whereby the banknote handling system can more efficiently prevent theft. In such a money handling system, when banknotes as proceeds from sales are collected from the money change machine and deposited in the money depositing/dispensing machine, an empty storage cassette is firstly mounted to the money change machine, banknotes in the money change machine are sent to the storage cassette, the storage cassette is thereafter dismounted from the money change machine, and the storage cassette is conveyed to the money depositing/dispensing machine. Thereafter, when the storage cassette is mounted to the money depositing/dispensing machine, the banknotes are fed out from the storage cassette and stored into the money depositing/dispensing machine. Meanwhile, when banknotes as change fund are dispensed from the money depositing/dispensing machine, and the money change machine is replenished with the change fund, an empty storage cassette is firstly mounted to the money depositing/dispensing machine, banknotes in the money depositing/dispensing machine are sent to the storage cassette, the storage cassette is thereafter dismounted from the money depositing/dispensing machine, and the storage cassette is conveyed to the money change machine. Thereafter, when the storage cassette is mounted to the money change machine, the banknotes are fed out from the storage cassette and stored into the money change machine.

SUMMARY OF THE INVENTION

In the money handling system that includes the money change machine and the money depositing/dispensing machine as disclosed in Japanese Laid-Open Patent Publication No. 2015-207311 and the like, a plurality of storage cassettes may be used in cases where a large number of banknotes are collected from the money change machine. In these cases, the plurality of storage cassettes to which banknotes have been sent from the money change machine are conveyed to the money depositing/dispensing machine, and the banknotes are thereafter stored into the money depositing/dispensing machine from the storage cassettes one by one in the money depositing/dispensing machine. However, in the conventional art, the money depositing/dispensing machine cannot obtain the number of storage cassettes which have been used for collecting money from the money change machine. Therefore, an operator may forget to mount one or more of the plurality of the storage cassettes to the money depositing/dispensing machine. In this case, a problem may arise that an error in calculation occurs in the money depositing/dispensing machine.

The present invention is made in view of such circumstances, and an object of the present invention is to provide a money handling system, a money handling machine, a money change machine, and a money handling method which can inhibit an operator from forgetting to mount one or more of a plurality of storage cassettes to the money handling machine even when the plurality of storage cassettes are used in a collection process in which money is collected from the money change machine and deposited in the money handling machine, to prevent an error in calculation from occurring in the money handling machine.

A money handling system of the present invention includes: a money change machine configured to deposit money as proceeds from sales and dispense money as change; and a money handling machine configured to deposit money collected from the money change machine, and a storage cassette for storing money and feeding out stored money is detachably mounted to each of the money change machine and the money handling machine, and the money handling system includes: a determination unit configured to determine whether or not money has been sent into the money handling machine from all of a plurality of the storage cassettes to which money has been sent from the money change machine when the plurality of the storage cassettes are used in a collection process in which money is collected from the money change machine and deposited in the money handling machine.

According to the money handling system, by determining whether or not money has been sent into the money handling machine from all of a plurality of the storage cassettes to which money has been sent from the money change machine when the plurality of the storage cassettes are used in a collection process in which money is collected from the money change machine and deposited in the money handling machine, it is possible to inhibit an operator from forgetting to mount one or more of a plurality of storage cassettes to the money handling machine for preventing an error in calculation from occurring in the money handling machine.

The money handling system of the present invention may further include a notification unit configured to make notification of information indicating whether or not money has been sent into the money handling machine from all the storage cassettes to which money has been sent from the money change machine in the collection process, based on a determination result by the determination unit.

In the money handling system of the present invention, the determination unit may be configured to determine that money has not been sent into the money handling machine from all the storage cassettes to which money has been sent from the money change machine in the collection process, when the number of the storage cassettes to which money has been sent from the money change machine is not identical to the number of the storage cassettes which have sent money into the money handling machine.

In the money handling system of the present invention, the storage cassette may have a storage medium, the money change machine may have a first writing unit configured to write information into the storage medium disposed in the storage cassette which is mounted to the money change machine, the money handling machine may have a first reading unit configured to read information from the storage medium disposed in the storage cassette which is mounted to the money handling machine, the first writing unit may be configured to write, in the storage medium of the storage cassette to which money has been sent last from the money change machine in the collection process, information indicating that money has been sent last to the storage cassette and information on the number of the storage cassettes to which money has been sent from the money change machine, and the determination unit may be configured to determine whether or not money has been sent into the money handling machine from all the storage cassettes to which money has been sent from the money change machine, based on the number of the storage cassettes mounted to the money handling machine and the number, of the storage cassettes to which money has been sent from the money change machine in the collection process, which is read from the storage medium disposed in the storage cassette by the first reading unit of the money handling machine.

In this case, when the storage cassette has been mounted to the money change machine in the collection process, information on the number indicating the order of the storage cassette to which money has been sent from the money change machine may be also written into the storage medium of the storage cassette by the first writing unit.

The money handling system of the present invention may further include a mounting order determination unit configured to determine that an error occurs in the order in which the storage cassette is mounted to the money handling machine, when the storage cassette which has been firstly mounted to the money handling machine is not the storage cassette to which money has been sent last from the money change machine, based on information that is read by the first reading unit from the storage medium disposed in the storage cassette which has been firstly mounted to the money handling machine in the collection process.

In the money handling system of the present invention, the money change machine may have a second writing unit configured to write information into a portable storage medium, the money handling machine may have a second reading unit configured to read information from the portable storage medium, information on the number of the storage cassettes to which money may have been sent from the money change machine in the collection process is written into the portable storage medium by the second writing unit of the money change machine, and the determination unit may be configured to determine whether or not money has been sent into the money handling machine from all the storage cassettes to which money has been sent from the money change machine, based on the number of the storage cassettes mounted to the money handling machine, and the number, of the storage cassettes to which money has been sent from the money change machine in the collection process, which is read from the portable storage medium by the second reading unit of the money handling machine.

In this case, identification information of each storage cassette to which money may have been sent from the money change machine in the collection process is also written into the portable storage medium by the second writing unit of the money change machine, and the identification information of each storage cassette to which money has been sent from the money change machine in the collection process may be read from the portable storage medium by the second reading unit.

In the money handling system of the present invention, the money change machine and the money handling machine may be connected so as to be communicable with each other, information on the number of the storage cassettes to which money has been sent from the money change machine in the collection process may be transmitted from the money change machine to the money handling machine, and the determination unit may be configured to determine whether or not money has been sent into the money handling machine from all the storage cassettes to which money has been sent from the money change machine, based on the number of the storage cassettes mounted to the money handling machine, and the number, of the storage cassettes to which money has been sent from the money change machine in the collection process, which is transmitted from the money change machine to the money handling machine.

In this case, identification information of each storage cassette to which money has been sent from the money change machine in the collection process may also be transmitted from the money change machine to the money handling machine.

The money handling system of the present invention may further include an unprocessed cassette information output unit configured to output information on the storage cassette to which money has been sent from the money change machine and which has not sent money into the money handling machine when the collection process is interrupted.

In the money handling system of the present invention, the money change machine may include a plurality of the money change machines, and the determination unit may be configured to determine, for each money change machine, whether or not money has been sent into the money handling machine from all the storage cassettes to which money has been sent from the money change machine in the collection process.

A money handling machine of the present invention which is configured to at least deposit money collected from another device includes: a cassette mounting unit to which a storage cassette for storing money and feeding out stored money is detachably mounted, and when the storage cassette is mounted to the cassette mounting unit in a collection process in which money is collected from another device and deposited in the money handling machine, money is sent from the storage cassette into the money handling machine, and the money handling machine includes a determination unit configured to determine, when a plurality of the storage cassettes are used in the collection process, whether or not money has been sent to the money handling machine from all the storage cassettes to which money has been sent from another device.

A money handling machine of the present invention which is configured to deposit money as proceeds from sales and dispense money as change includes: a cassette mounting unit to which a storage cassette for storing money and feeding out stored money is detachably mounted, and when the storage cassette is mounted to the cassette mounting unit in a collection process in which money is collected from the money change machine and deposited in another device, money is sent to the storage cassette from the money change machine, and the money change machine includes a number-of-cassettes output unit configured to output, when a plurality of the storage cassettes are used in the collection process, information on the number of the storage cassettes to which money has been sent from the money change machine.

A money handling method of the present invention which is performed by a money handling system that includes: a money change machine configured to deposit money as proceeds from sales and dispense money as change; and a money handling machine configured to deposit money collected from the money change machine, and that configured to allow a storage cassette for storing money and feeding out stored money to be detachably mounted to each of the money change machine and the money handling machine, includes: sending money to the storage cassette from the money change machine when the storage cassette is mounted to the money change machine, and sending money from the storage cassette into the money handling machine when the storage cassette is dismounted from the money change machine and mounted to the money handling machine, and whether or not money has been sent into the money handling machine from all the storage cassettes to which money has been sent from the money change machine is determined when a plurality of the storage cassettes are used in a collection process in which money is collected from the money change machine and deposited in the money handling machine.

According to the money handling system, by determining whether or not money has been sent into the money handling machine from all of a plurality of the storage cassettes to which money has been sent from the money change machine when the plurality of the storage cassettes are used in a collection process in which money is collected from the money change machine and deposited in the money handling machine, it is possible to inhibit an operator from forgetting to mount one or more of a plurality of storage cassettes to the money handling machine for preventing an error in calculation from occurring in the money handling machine.

The money handling machine of the present invention includes: a cassette mounting unit to which a storage cassette for storing money and feeding out stored money is detachably mounted; a storage/feeding unit capable of storing money and feeding out stored money; and a controller configured to perform control such that money is sent from the storage/feeding unit to the empty storage cassette mounted to the cassette mounting unit according to a storing state of money in the storage/feeding unit.

In the money handling machine having such a configuration, since money is sent from the storage/feeding unit to the empty storage cassette mounted to the cassette mounting unit, according to a storing state of money in the storage/feeding unit, even when money in the storage/feeding unit becomes insufficient while change fund is prepared, replenishment of money can be performed merely by mounting the storage cassette, whereby, for example, an operation of taking out money from a collection cassette can be eliminated, and this can reduce an operator's workload and a replenishing time.

The money handling machine of the present invention may further include a usage determination unit configured to determine a usage of the storage cassette mounted to the cassette mounting unit, according to a storing state of money in the storage/feeding unit.

In this case, the usage determination unit may determine, as storage, the usage of the storage cassette mounted to the cassette mounting unit when money can no longer be stored in the storage/feeding unit.

The usage determination unit may determine, as storage, the usage of the storage cassette mounted to the cassette mounting unit only in a case where no money is stored in the storage cassette when the storage cassette is mounted to the cassette mounting unit.

In the money handling machine of the present invention, the storage cassette may have a storage medium. The money handling machine may further include a writing unit configured to write information into the storage medium disposed in the storage cassette which is mounted to the cassette mounting unit. Information on the usage of the storage cassette which is determined by the usage determination unit may be written by the writing unit into the storage medium disposed in the storage cassette.

In this case, the money handling machine of the present invention may further include a reading unit configured to read information from the storage medium disposed in the storage cassette which is mounted to the cassette mounting unit.

In a case where the usage, of the storage cassette which is read by the reading unit from the storage medium disposed in the storage cassette when the storage cassette is mounted to the cassette mounting unit, is storage, money may be sent from the storage/feeding unit to the storage cassette in the case of no money being stored in the storage cassette mounted to the cassette mounting unit, and money may be sent from the storage cassette to the storage/feeding unit in the case of money being stored in the storage cassette mounted to the cassette mounting unit.

In a case where the usage, of the storage cassette which is read by the reading unit from the storage medium disposed in the storage cassette when the storage cassette is mounted to the cassette mounting unit, is collection, money may be sent to the storage/feeding unit from the storage cassette mounted to the cassette mounting unit.

In a case where the usage, of the storage cassette which is read by the reading unit from the storage medium disposed in the storage cassette when the storage cassette is mounted to the cassette mounting unit, is replenishment, money may be sent from the storage/feeding unit to the storage cassette mounted to the cassette mounting unit.

In a case where information indicating that the usage of the storage cassette is storage is written by the writing unit into the storage medium disposed in the storage cassette which is mounted to the cassette mounting unit, information on money as change fund with which a money change machine disposed separately from the money handling machine is to be replenished may be also written into the storage medium by the writing unit.

In the money handling machine of the present invention, the storage cassette may have a recognition medium representing identification information of the storage cassette. The money handling machine may further include: an identification information reading unit configured to read the identification information of the storage cassette from the recognition medium disposed in the storage cassette which is mounted to the cassette mounting unit; and a memory. Information on the usage of the storage cassette which is determined by the usage determination unit may be stored in the memory so as to be associated with the identification information of the storage cassette which is read by the identification information reading unit In this case, in a case where, when the storage cassette is mounted to the cassette mounting unit, the usage of the storage cassette which corresponds to the storage cassette identification information read by the identification information reading unit from the recognition medium disposed in the storage cassette, is storage according to the usage of the storage cassette which is stored in the memory for each identification information, money may be sent from the storage/feeding unit to the storage cassette in the case of no money being stored in the storage cassette mounted to the cassette mounting unit, and money may be sent from the storage cassette to the storage/feeding unit in the case of money being stored in the storage cassette mounted to the cassette mounting unit.

The money handling system of the present invention includes a money change machine configured to deposit money as proceeds from sales and dispense money as change; and a money handling machine configured to deposit money collected from the money change machine and dispense money as change fund with which the money change machine is to be replenished. In the money handling system, a storage cassette for storing money and feeding out stored money is detachably mounted to each of the money change machine and the money handling machine. The money handling machine includes a storage/feeding unit capable of storing money and feeding out stored money. The money handling system includes a controller configured to perform control such that money is sent from the storage/feeding unit to an empty storage cassette mounted to the money handling machine according to a storing state of money in the storage/feeding unit of the money handling machine.

In the money handling system having such a configuration, since money is sent from the storage/feeding unit to the empty storage cassette mounted to the money handling machine, according to a storing state of money in the storage/feeding unit in the money handling machine, even when money in the storage/feeding unit becomes insufficient while change fund is prepared in the money handling machine, replenishment of money can be performed merely by mounting the storage cassette, whereby, for example, an operation of taking out money from a collection cassette can be eliminated, and this can reduce an operator's workload and a replenishing time.

The money handling system of the present invention may include a usage determination unit configured to determine a usage of the storage cassette mounted to the money handling machine, according to a storing state of money in the storage/feeding unit of the money handling machine.

In this case, the storage cassette may have a storage medium. The money handling machine may include a writing unit configured to write information in the storage medium disposed in the storage cassette which is mounted to the money handling machine. Information on the usage of the storage cassette which is determined by the usage determination unit may be written by the writing unit into the storage medium disposed in the storage cassette.

Alternatively, the storage cassette may have a recognition medium representing identification information of the storage cassette. The money handling machine may include an identification information reading unit configured to read the identification information of the storage cassette from the recognition medium disposed in the storage cassette which is mounted to the money handling machine. A memory may be provided for storing information on the usage of the storage cassette which is determined by the usage determination unit and the identification information of the storage cassette which is read by the identification information reading unit so as to associate the information on the usage of the storage cassette and the identification information with each other.

The money handling method of the present invention is directed to a money handling method performed by a money handling machine that includes: a cassette mounting unit to which a storage cassette for storing money and feeding out stored money is detachably mounted, and a storage/feeding unit capable of storing money and feeding out stored money. The money handling method includes mounting the storage cassette to the cassette mounting unit, and sending money from the storage/feeding unit to the empty storage cassette mounted to the cassette mounting unit, according to a storing state of money in the storage/feeding unit.

In the money handing method having such a configuration, since money is sent from the storage/feeding unit to the empty storage cassette mounted to the money handling machine, according to a storing state of money in the storage/feeding unit in the money handling machine, even when money in the storage/feeding unit becomes insufficient while change fund is prepared in the money handling machine, replenishment of money can be performed merely by mounting the storage cassette, whereby, for example, an operation of taking out money from a collection cassette can be eliminated, and this can reduce an operator's workload and a replenishing time.

The money handling method of the present invention may further include determining a usage of the storage cassette mounted to the cassette mounting unit according to a storing state of money in the storage/feeding unit.

In this case, the storage cassette may have a storage medium, and the money handling method may further include writing information on the determined usage of the storage cassette in the storage medium disposed in the storage cassette.

Alternatively, in the money handling method of the present invention, the storage cassette may have a recognition medium representing identification information of the storage cassette. The money handling method may further include reading the identification information of the storage cassette from the recognition medium disposed in the storage cassette which is mounted to the cassette mounting unit, and storing, in a memory, information on the determined usage of the storage cassette so as to associate the information on the usage of the storage cassette with the read identification information of the storage cassette.

BRIEF DESCRIPTION OF THE DRAWINGS

FIG. 6 shows a table representing a corresponding relationship between a usage of a storage cassette mounted to a cassette mounting unit and an operation performed when the storage cassette is mounted to the cassette mounting unit in the money depositing/dispensing machine shown in FIG. 4;

FIG. 14 shows a table representing a corresponding relationship, between identification numbers and usages of storage cassettes, to be stored in a memory of the money depositing/dispensing machine shown in FIG. 13;

DESCRIPTION OF THE PREFERRED EMBODIMENTS

Embodiments of the present invention will be described below with reference to the drawings. FIG. 1 to FIG. 10 illustrate a money handling system according to the present embodiment and a money change machine, a money depositing/dispensing machine, and the like which are disposed in the money handling system.

Figure 1:
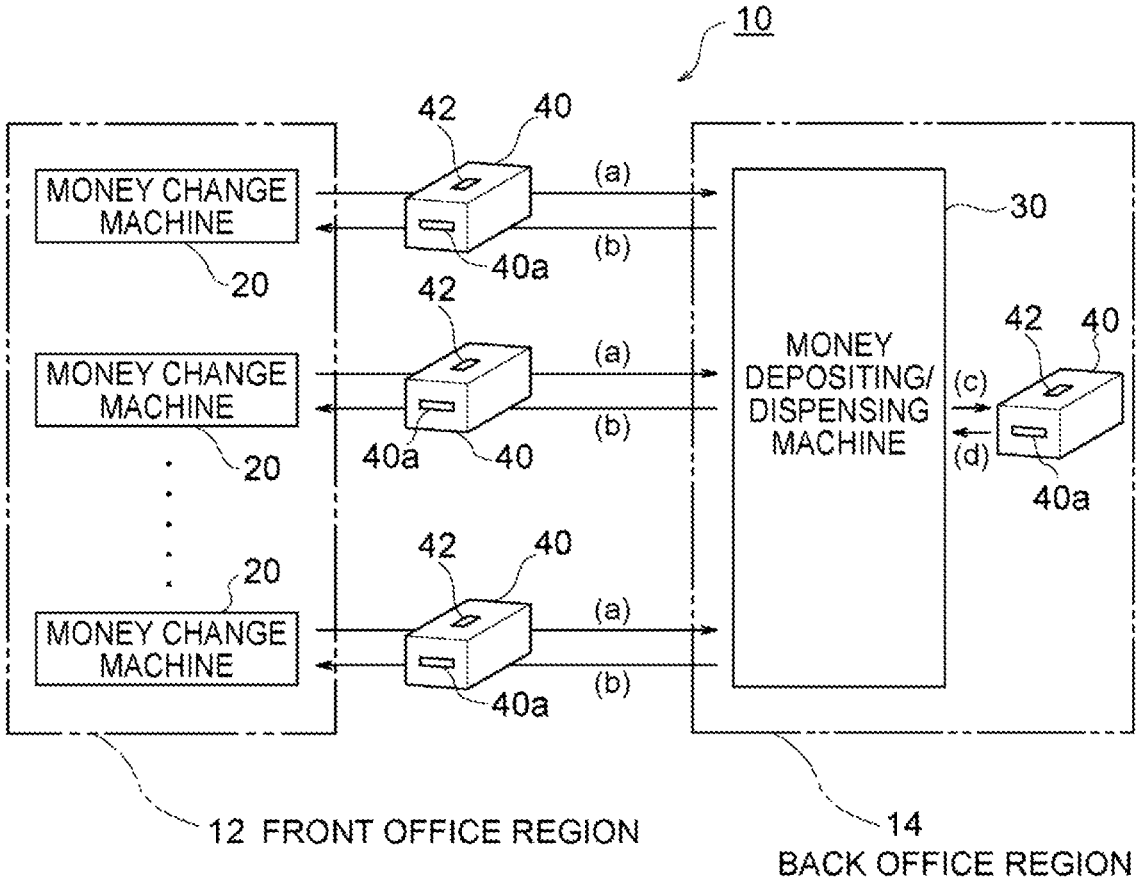
FIG. 1 is a schematic diagram illustrating an example of a schematic configuration of a money handling system according to an embodiment of the present invention.

As shown in FIG. 1, in stores of commercial facilities such as convenience stores and supermarkets, store shelves in which various commodities are displayed are arranged in a front office region 12 which customers are allowed to enter, and a money change machine 20 and a POS register 60 (see FIG. 2) are installed at a settlement place (specifically, a manned checkout counter) in the front office region 12. When a plurality of settlement places are in the front office region 12, the money change machine 20 and the POS register 60 are installed for each settlement place. When a customer proceeds to checkout at such a settlement place, a clerk performs depositing of money received from the customer for the commodity in the money change machine 20, or performs dispensing of money as change from the money change machine 20 and delivers the change to customer. Furthermore, information on commodities purchased by customers, information on money stored in the money change machine 20, and the like are managed by the POS register 60.

In a back office region 14 (specifically, for example, accounting room), in such a store, which customers are not allowed to enter, a money depositing/dispensing machine 30 (specifically, for example, cashier machine) is installed. The money depositing/dispensing machine 30 installed in the back office region 14 can deposit money, as proceeds from sales for the store, which are collected from the money change machine 20. When money as change is insufficient in the money change machine 20, the money depositing/dispensing machine 30 dispenses money as change fund, and the money change machine 20 can be replenished with the money as the change fund dispensed from the money depositing/dispensing machine 30.

In the present embodiment, the money change machine 20 and the money depositing/dispensing machine 30 having such configurations are combined to configure the money handling system 10 according to the present invention. In the money handling system 10 having such a configuration, banknotes are delivered between the money change machine 20 and the money depositing/dispensing machine 30 by using a storage cassette 40 for storing banknotes and feeding out the stored banknotes. A plurality of the storage cassettes 40 are disposed so as to correspond to the respective money change machines 20. Each of the plurality of the storage cassettes 40 has its corresponding identification information such as an identification number. Specifically, corresponding identification numbers starting from, for example, 001 are sequentially assigned to the respective storage cassettes 40. The plurality of the storage cassettes 40 have almost rectangular-parallelepiped-shaped casings having almost the same size, and banknotes are stored in the casings. Each storage cassette 40 has a storage medium 42 such as an IC tag for storing various information such as the identification information of the storage cassette 40 and information on banknotes stored in the storage cassette 40. As described below, the storage cassette 40 is detachably mounted to each of the money change machine 20 and the money depositing/dispensing machine 30. An opening 40*a* is disposed in the side surface of the storage cassette 40. When the storage cassette 40 is mounted to the money change machine 20 or the money depositing/dispensing machine 30, banknotes are sent into the storage cassette 40 through the opening 40*a* from a transport unit (described below) of the money change machine 20 or the money depositing/dispensing machine 30, and banknotes are fed out from the storage cassette 40 and sent to the transport unit of the money change machine 20 or the money depositing/dispensing machine 30 through the opening 40*a*.

Configurations of the money change machine 20 and the money depositing/dispensing machine 30 will be described below in detail.

Figure 2:
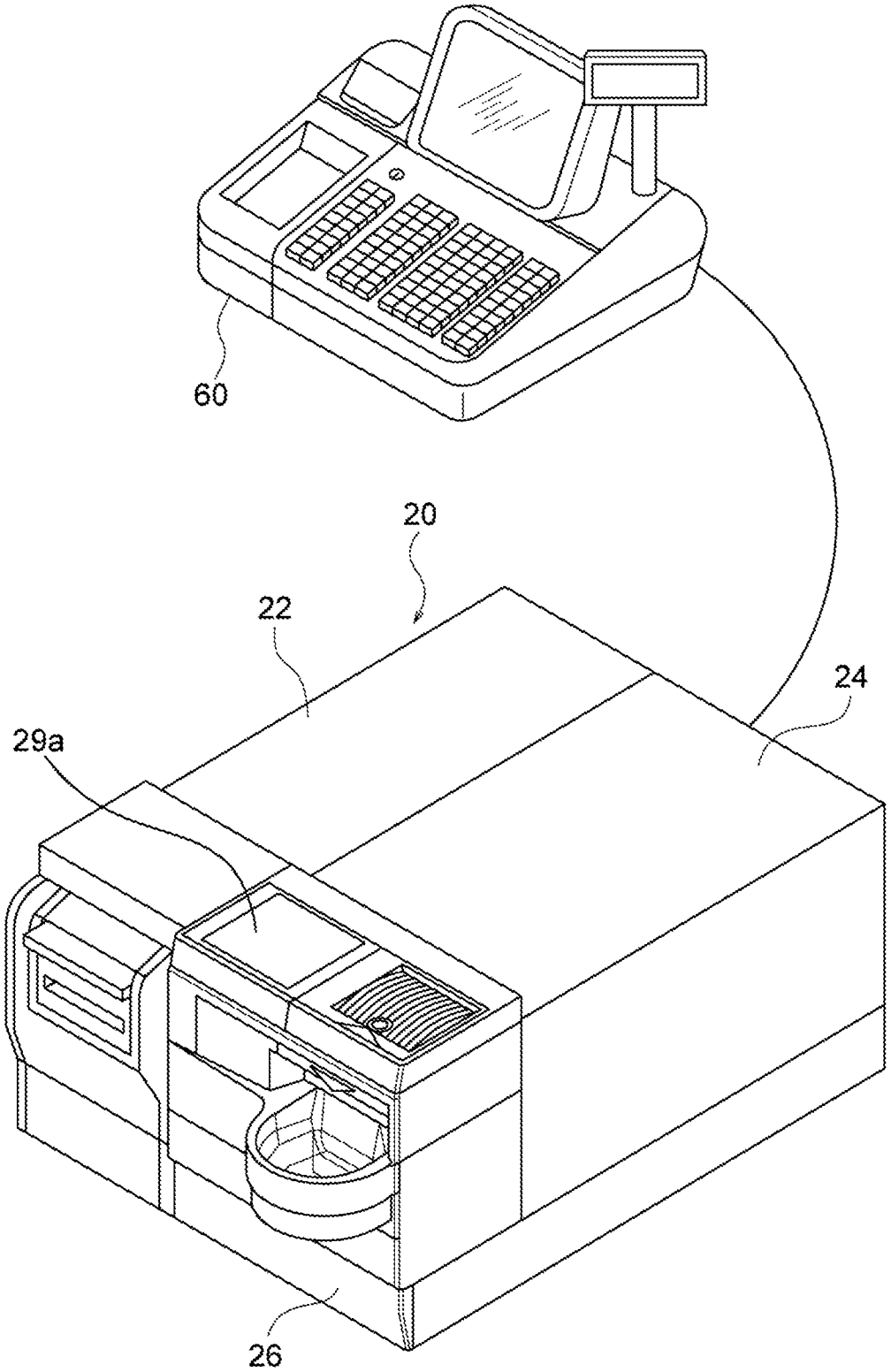
FIG. 2 is a perspective view of configurations of a money change machine and a POS register disposed in the money change machine in the money handling system shown in FIG. 1.
Figure 3:
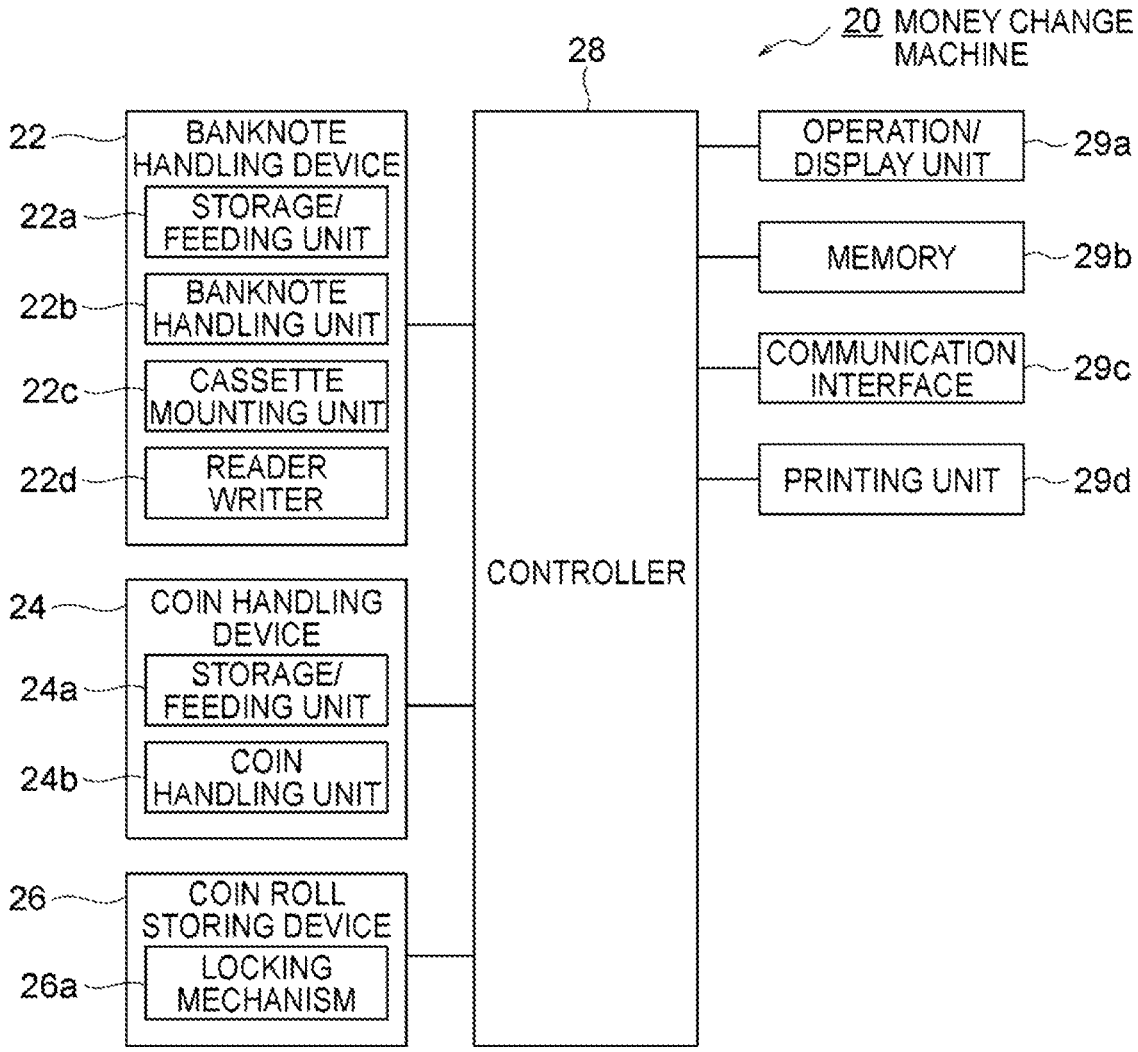
FIG. 3 is a functional block diagram illustrating a configuration of a control system of the money change machine shown in FIG. 2.

Firstly, the configuration of the money change machine 20 disposed in the front office region 12 of a store will be described in detail with reference to FIG. 2 and FIG. 3. As shown in FIG. 2, the money change machine 20 of the present embodiment includes a coin handling device 24 and a coin roll storing device 26 aligned in the up-down direction, and a banknote handling device 22 aligned adjacent to the coin handling device 24 and the coin roll storing device 26. The POS register 60 is placed on the upper surfaces of the banknote handling device 22 and the coin handling device 24. An operation/display unit 29*a* such as a touch panel is disposed at the upper portion of the coin handling device 24. The banknote handling device 22 and the coin handling device 24 deposit and dispense banknotes and coins, respectively. The coin roll storing device 26 stores coin rolls (each coin roll is formed by only a predetermined number (for example, 20 or 50) of coins of the same denomination being collected in a roll and wrapped with a film, wrapping paper, or the like) of each denomination such that the coin rolls can be taken out. In the coin roll storing device 26, mediums (for example, vouchers and the like) other than banknotes and coins can be stored. The POS register 60 is used as a management device for managing the money change machine 20.

The banknote handling device 22 includes an inlet through which banknotes are inserted into a housing from the outside, a transport unit for transporting banknotes one by one in the housing, a recognition unit for performing recognition of a denomination, authentication, fitness, a transport state, and the like of the banknote transported by the transport unit, and a dispensing unit for dispensing banknotes from the housing to the outside. As shown in FIG. 3, the banknote handling device 22 includes a storage/feeding unit 22*a* capable of storing banknotes sent from the transport unit and feeding out the stored banknotes one by one to the transport unit. A banknote handling unit 22*b* for handling banknotes is configured by the inlet, the transport unit, the recognition unit, the dispensing unit, and the like described above. The banknote handling device 22 includes a cassette mounting unit 22*c* to which the storage cassette 40 is mounted. When the storage cassette 40 is mounted to the cassette mounting unit 22*c* of the banknote handling device 22, banknotes are sent into the storage cassette 40 through the opening 40*a* from the transport unit (not shown) disposed in the banknote handling device 22, and banknotes stored in the storage cassette 40 are fed out to the transport unit of the banknote handling device 22 through the opening 40*a*. More specifically, a banknote feeding mechanism for feeding out banknotes stored in the storage cassette 40 through the opening 40*a* to the outside is disposed inside the storage cassette 40. When the storage cassette 40 is mounted to the cassette mounting unit 22*c* of the banknote handling device 22, power is transmitted to the banknote feeding mechanism of the storage cassette 40 from the banknote handling device 22. Thus, in a state where the storage cassette 40 has been dismounted from the cassette mounting unit 22*c* of the banknote handling device 22, banknotes stored in the storage cassette 40 cannot be fed out to the outside, and, therefore, security can be improved for the banknotes stored in the storage cassette 40. The banknote handling device 22 includes a reader writer 22*d* for reading information from the storage medium 42 of the storage cassette 40 mounted to the cassette mounting unit 22*c* and writing information into the storage medium 42.

The coin handling device 24 includes an inlet through which coins are inserted into the housing from the outside, a transport unit for transporting coins one by one in the housing, a recognition unit for performing recognition of a denomination, authentication, fitness, a transport state, and the like of the coin transported by the transport unit, and a dispensing unit for dispensing coins from the housing to the outside. As shown in FIG. 3, the coin handling device 24 includes a storage/feeding unit 24*a* capable of storing coins sent from the transport unit and feeding out the stored coins one by one to the transport unit. A coin handling unit 24*b* for handling coins is configured by the inlet, the transport unit, the recognition unit, the dispensing unit, and the like described above.

The coin roll storing device 26 includes a storage drawer (not shown) which is drawable forward from the housing, and a locking mechanism 26*a* for locking the storage drawer in the housing. A plurality of coin rolls can be stored in the storage drawer. When the storage drawer is unlocked by the locking mechanism 26*a*, an operator is allowed to draw the storage drawer forward from the housing to take out coin rolls from the storage drawer or store coin rolls in the storage drawer. In the storage drawer, mediums (for example, vouchers and the like) other than banknotes and coins can also be stored.

Next, a configuration of a control system of the money change machine 20 having such a configuration will be described with reference to FIG. 3. As shown in FIG. 3, the money change machine 20 includes a controller 28 such as a central processing unit (CPU), and each component of the banknote handling device 22, the coin handling device 24, and the coin roll storing device 26 is connected to the controller 28. Thus, information which is read from the storage medium 42 of the storage cassette 40 by the reader writer 22*d* is transmitted to the controller 28. The controller 28 transmits an instruction to each component of the banknote handling device 22, the coin handling device 24, and the coin roll storing device 26, to control the component. As shown in FIG. 3, the operation/display unit 29*a*, a memory 29*b*, a communication interface 29*c*, and a printing unit 29*d* are connected to the controller 28. On the operation/display unit 29*a*, for example, information on inventory amounts of banknotes and coins that are stored in the banknote handling device 22, the coin handling device 24, and the coin roll storing device 26, and information on handling states of banknotes and coins, are displayed. The operator is allowed to input various instructions through the operation/display unit 29*a* to the controller 28. In the memory 29*b*, for example, information on inventory amounts of banknotes and coins that are stored in the banknote handling device 22, the coin handling device 24, and the coin roll storing device 26, and information on the handling histories of banknotes and coins are stored. The controller 28 can perform signal transmission and reception to and from an external device such as the POS register 60 through the communication interface 29*c*. The printing unit 29*d* prints, on a receipt, information on inventory amounts of banknotes and coins that are stored in the banknote handling device 22, the coin handling device 24, and the coin roll storing device 26, information on handling histories of banknotes and coins, and the like.

Next, a configuration of the money depositing/dispensing machine 30 such as a cashier machine disposed in the back office region 14 of the store will be described in detail with reference to FIG. 4 and FIG. 5. The money depositing/dispensing machine 30 installed in the back office region 14 can deposit money as proceeds from sales, for the store, collected from the money change machine 20. When money as change is insufficient in the money change machine 20, money as change fund is dispensed from the money depositing/dispensing machine 30, and the money change machine 20 can be replenished with the money as change fund dispensed from the money depositing/dispensing machine 30.

Figure 4:
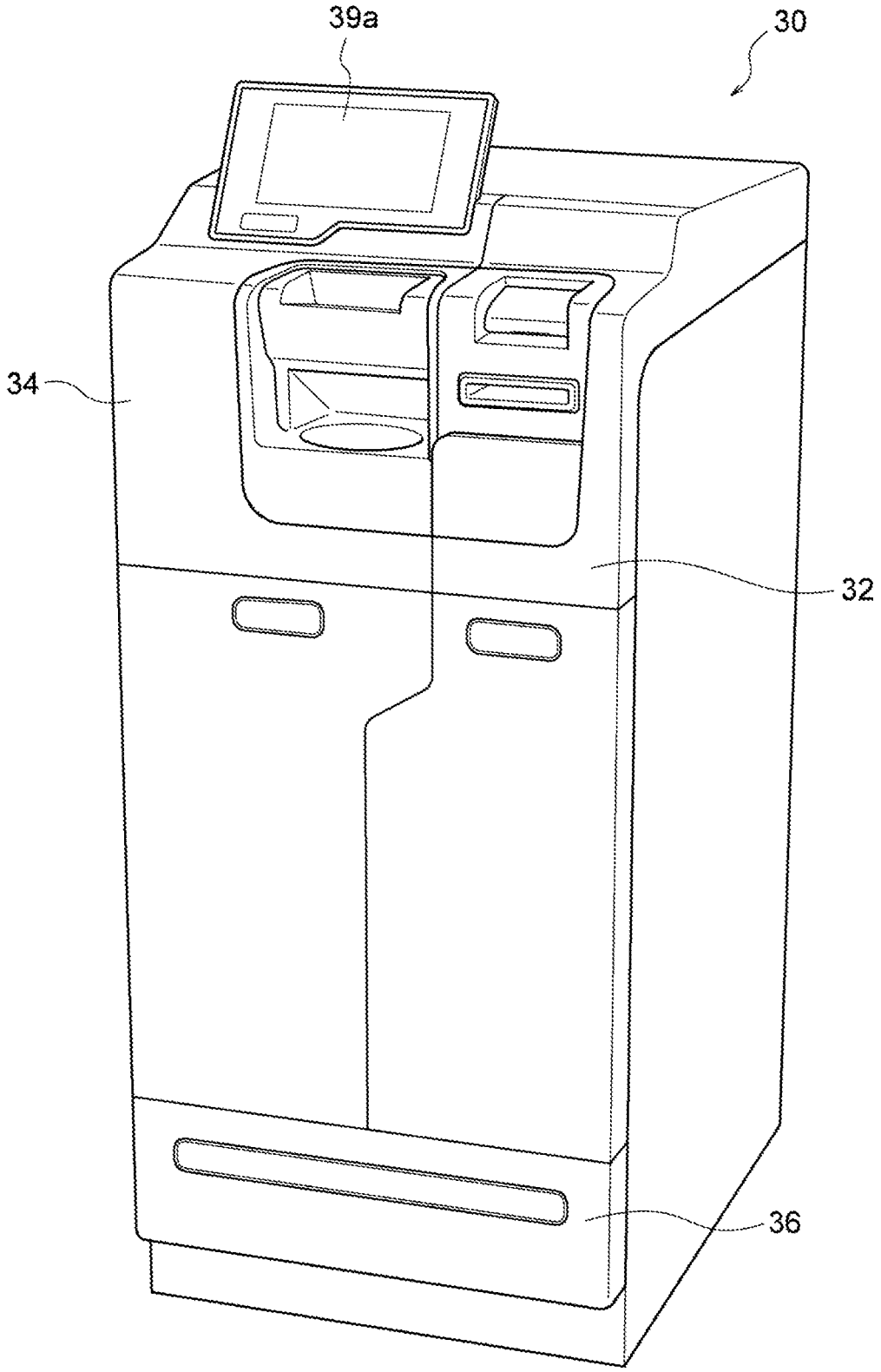
FIG. 4 is a perspective view of a configuration of a money depositing/dispensing machine in the money handling system shown in FIG. 1.

As shown in FIG. 4, the money depositing/dispensing machine 30 includes a banknote handling device 32 for depositing and dispensing banknotes, a coin handling device 34 for depositing and dispensing coins, and a coin roll storing device 36 for storing coin rolls. As shown in FIG. 4, the banknote handling device 32 and the coin handling device 34 are aligned in the right-left direction when viewed from the front of the money depositing/dispensing machine 30, and the coin roll storing device 36 is disposed below the banknote handling device 32 and the coin handling device 34. An operation/display unit 39*a* such as a touch panel is disposed at the upper portion of the coin handling device 34. The banknote handling device 32 and the coin handling device 34 deposit and dispense banknotes and coins, respectively. The coin roll storing device 36 stores coin rolls of each denomination such that the coin rolls can be taken out. In the coin roll storing device 36, mediums (for example, vouchers and the like) other than banknotes and coins can be stored.

The banknote handling device 32 includes an inlet through which banknotes are inserted into a housing from the outside, a transport unit for transporting banknotes one by one in the housing, a recognition unit for performing recognition of a denomination, authentication, fitness, a transport state, and the like of the banknote transported by the transport unit, and a dispensing unit for dispensing banknotes from the housing to the outside. As shown in FIG. 5, the banknote handling device 32 includes a storage/feeding unit 32*a* capable of storing banknotes transported from the transport unit, and feeding out the stored banknotes one by one to the transport unit. The banknote handling device 32 includes a collection cassette (not shown) for storing banknotes sent from the transport unit, and a guard of a cash-in-transit company is allowed to collect banknotes stored in the collection cassette from the banknote handling device 32 together with the collection cassette. A banknote handling unit 32*b* for handling banknotes is configured by the inlet, the transport unit, the recognition unit, the dispensing unit, and the like described above. The banknote handling device 32 includes a cassette mounting unit 32*c* to which the storage cassette 40 is mounted. When the storage cassette 40 is mounted to the cassette mounting unit 32*c* of the banknote handling device 32, banknotes are sent into the storage cassette 40 through the opening 40*a* from the transport unit (not shown) disposed in the banknote handling device 32, and banknotes stored in the storage cassette 40 are fed out to the transport unit of the banknote handling device 32 through the opening 40*a*. More specifically, when the storage cassette 40 is mounted to the cassette mounting unit 32*c* of the banknote handling device 32, power is transmitted to a banknote feeding mechanism of the storage cassette 40 from the banknote handling device 32. The banknote handling device 32 includes a reader writer 32*d* for reading information from the storage medium 42 of the storage cassette 40 mounted to the cassette mounting unit 32*c*, and writing information into the storage medium 42.

The coin handling device 34 includes an inlet through which coins are inserted into the housing from the outside, a transport unit for transporting coins one by one in the housing, a recognition unit for performing recognition of a denomination, authentication, fitness, a transport state, and the like of the coin transported by the transport unit, and a dispensing unit for dispensing coins from the housing to the outside. As shown in FIG. 5, the coin handling device 34 includes a storage/feeding unit 34*a* capable of storing coins sent from the transport unit and feeding out the stored coins one by one to the transport unit. The coin handling device 34 includes a collection cassette (not shown) for storing coins sent from the transport unit, and the guard of the cash-in-transit company is allowed to collect coins stored in the collection cassette from the coin handling device 34 together with the collection cassette. A coin handling unit 34*b* for handling coins is configured by the inlet, the transport unit, the recognition unit, the dispensing unit, and the like described above.

The coin roll storing device 36 includes a storage drawer (not shown) which is drawable forward from the housing, and a locking mechanism 36*a* for locking the storage drawer in the housing. A plurality of coin rolls can be stored in the storage drawer. When the storage drawer is unlocked by the locking mechanism 36*a*, the operator is allowed to draw the storage drawer forward from the housing to take out coin rolls from the storage drawer or store coin rolls in the storage drawer. In the storage drawer, mediums (for example, vouchers and the like) other than banknotes and coins can also be stored.

Next, a configuration of a control system of the money depositing/dispensing machine 30 having such a configuration will be described with reference to FIG. 5. As shown in FIG. 5, the money depositing/dispensing machine 30 includes a controller 38 such as a central processing unit (CPU), and each component of the banknote handling device 32, the coin handling device 34, and the coin roll storing device 36 is connected to the controller 38. Thus, information read from the storage medium 42 of the storage cassette 40 by the reader writer 32*d* is transmitted to the controller 38. The controller 38 transmits an instruction to each component of the banknote handling device 32, the coin handling device 34, and the coin roll storing device 36 to control the component. As shown in FIG. 5, the operation/display unit 39*a*, a memory 39*b*, a communication interface 39*c*, and a printing unit 39*d* are connected to the controller 38. On the operation/display unit 39*a*, for example, information on inventory amounts of banknotes and coins stored in the banknote handling device 32, the coin handling device 34, and the coin roll storing device 36, and information on handling states of banknotes and coins are displayed. The operator is allowed to input various instructions through the operation/display unit 39*a* to the controller 38. In the memory 39*b*, for example, information on inventory amounts of banknotes and coins stored in the banknote handling device 32, the coin handling device 34, and the coin roll storing device 36, and information on handling histories of banknotes and coins are stored. The controller 38 can perform signal transmission and reception to and from an external device such as a higher-ranking terminal through the communication interface 39*c*. The controller 38 may perform signal transmission and reception to and from a management computer or the like which is disposed in a management center in the cash-in-transit company through the communication interface 39*c*. The printing unit 39*d* prints, on a receipt, information on inventory amounts of banknotes and coins stored in the banknote handling device 32, the coin handling device 34, and the coin roll storing device 36, information on handling histories of banknotes and coins, and the like.

In the present embodiment, the controller 38 performs control such that banknotes are sent from the storage/feeding unit 32*a* to an empty storage cassette 40 mounted to the cassette mounting unit 32*c* according to a storing state of banknotes in the storage/feeding unit 32*a* of the banknote handling device 32. Such a function of the controller 38 will be described below. As shown in FIG. 5, a usage determination unit 50 for determining the usage of the storage cassette 40 mounted to the cassette mounting unit 32*c*, according to a storing state of banknotes in the storage/feeding unit 32*a* of the banknote handling device 32 is connected to the controller 38. Examples of the usage of the storage cassette 40 which is determined by the usage determination unit 50 include collection, replenishment, storage, and the like. Such a function of the usage determination unit 50 will be described below in detail.

Figure 5:
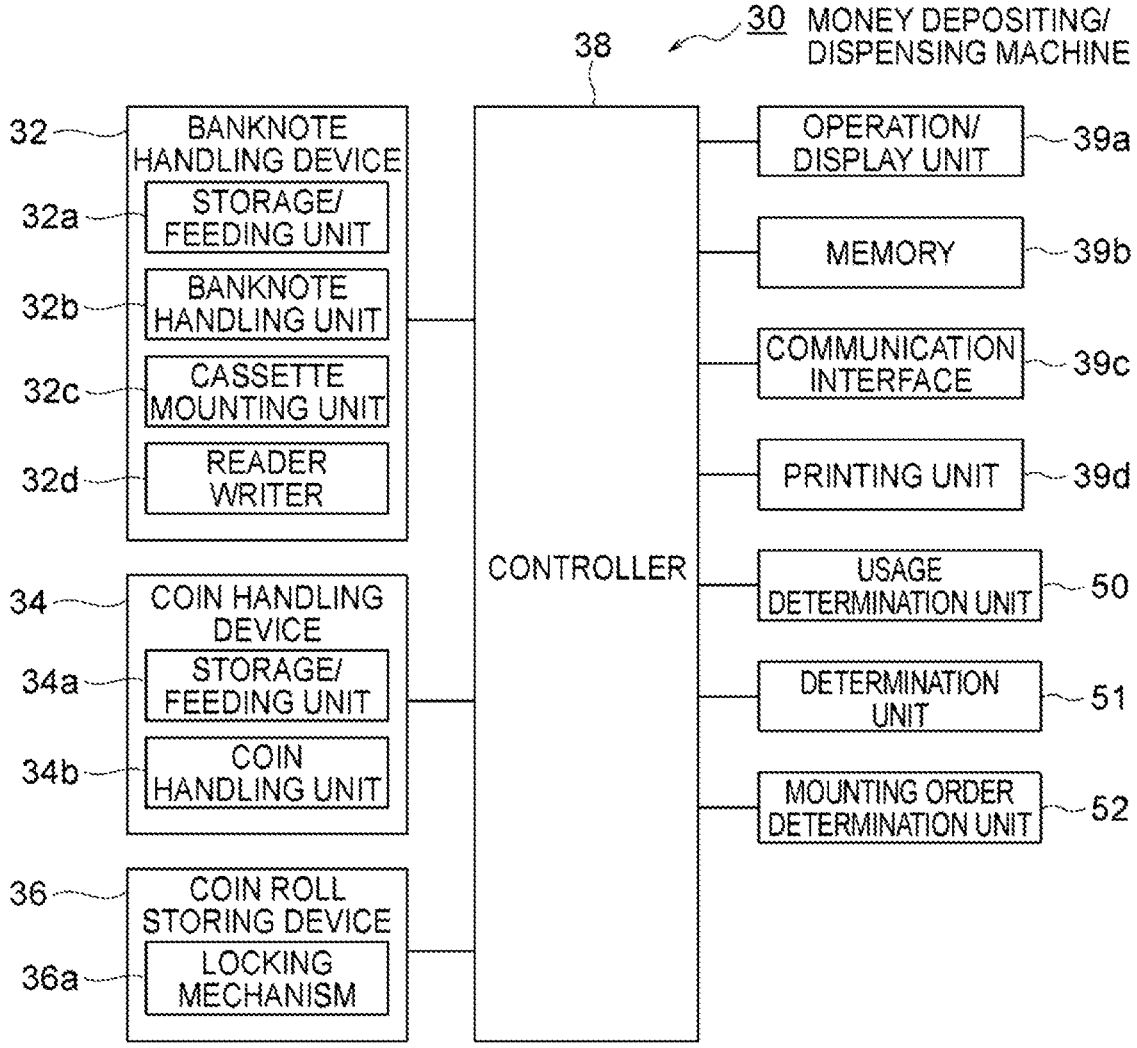
FIG. 5 is a functional block diagram illustrating a configuration of a control system of the money depositing/dispensing machine shown in FIG. 4.

As shown in FIG. 5, a determination unit 51 and a mounting order determination unit 52 are connected to the controller 38. The determination unit 51 determines whether or not banknotes have been sent into the money depositing/dispensing machine 30 from all the storage cassettes 40 to which the banknotes have been sent from the money change machine 20 when the plurality of the storage cassettes 40 are used in a collection process in which money is collected from the money change machine 20 and deposited in the money depositing/dispensing machine 30. The mounting order determination unit 52 determines whether or not an error in the order in which the storage cassettes 40 are mounted to the money depositing/dispensing machine 30 has occurred when the plurality of the storage cassettes 40 are used in the above-described collection process. Functions of the determination unit 51 and the mounting order determination unit 52 will be described below in detail.

Next, an operation (hereinafter, also referred to as collection process) as indicated by reference numeral (a) in FIG. 1 for collecting money as proceeds from sales, from the money change machine 20, and storing the money in the money depositing/dispensing machine 30, and an operation (hereinafter, also referred to as replenishing process) as indicated by reference numeral (b) in FIG. 1 for dispensing money as change fund from the money depositing/dispensing machine 30 and replenishing the money change machine 20 with the money, in the money handling system 10 shown in FIG. 1 to FIG. 5, will be described below.

Firstly, the operation (that is, operation indicated by reference numeral (a) in FIG. 1) performed by the money handling system 10 during the collection process will be described. After the business hours of the store end, a clerk in charge of a register who has performed commodity settlement at the settlement place collects money and mediums (for example, vouchers and the like) other than the money from the money change machine 20. Specifically, the clerk in charge of the register mounts the empty storage cassette 40 to the cassette mounting unit 22*c* of the banknote handling device 22, and thus stores, in the storage cassette 40, banknotes as proceeds from sales which are stored in the storage/feeding unit 22*a* of the banknote handling device 22. The clerk in charge of the register also performs dispensing of coins, as proceeds from sales, which are stored in storage/feeding unit 24*a* of the coin handling device 24. The clerk in charge of the register stores, with her/his hands, coins dispensed from the coin handling device 24, in a storage case (not shown). The clerk in charge of the register also takes out mediums (for example, vouchers and the like), other than banknotes and coins, which are stored in the coin roll storing device 26, with her/his hands, and stores the taken mediums into the storage case with her/his hands. When banknotes and coins as proceeds from sales have been collected from the banknote handling device 22, the coin handling device 24, and the like, information (specifically, the number of the banknotes and the number of coins for each denomination) on the banknotes and the coins collected from the banknote handling device 22 and the coin handling device 24, and the like are written into the storage medium 42 of the storage cassette 40, by the reader writer 22*d*. The identification number of the settlement place at which the money change machine 20 is installed and the identification number of the clerk in charge of the register may be written into the storage medium 42 of the storage cassette 40 by the reader writer 22*d*. In the present embodiment, as described below, when the plurality of the storage cassettes 40 are used in the collection process, information indicating whether or not the storage cassette 40 having been mounted to the cassette mounting unit 22*c* is the last cassette, and information on the number indicating the order in which the storage cassette 40 has been used in the collection process are written into the storage medium 42 of the storage cassette 40 by the reader writer 22*d*. When the clerk in charge of the register collects money and mediums other than the money from the money change machine 20, information on the collected money and the like are printed on a receipt by the printing unit 29*d* such as a printer. The clerk in charge of the register also stores the receipt on which the information is printed by the printing unit 29*d* such as the printer, into the storage case with her/his hand.

The clerk, in charge of the register, who has collected money and mediums other than the money from the money change machine 20 in the front office region 12 collectively conveys the storage cassette 40 and the storage case from the front office region 12 to the back office region 14. Thereafter, the clerk in charge of the register mounts the storage cassette 40 to the cassette mounting unit 32*c* in the banknote handling device 32 of the money depositing/dispensing machine 30. Thus, banknotes, as proceeds from sales, which are stored in the storage cassette 40 are fed out from the storage cassette 40, sent into the housing of the banknote handling device 32, and stored in the storage/feeding unit 32*a* of the banknote handling device 32. The clerk in charge of the register takes out the coins as proceeds from sales, from the storage case, and performs depositing of the taken coins in the coin handling device 34. Thus, the coins, as proceeds from sales, collected from the coin handling device 24 are stored in the storage/feeding unit 34*a* of the coin handling device 34. The clerk in charge of the register takes out the mediums (for example, vouchers and the like) other than banknotes and coins, from the storage case, with her/his hands, and stores the taken mediums in the coin roll storing device 36. In the present embodiment, when the storage cassette 40 is mounted to the cassette mounting unit 32*c* in the banknote handling device 32 of the money depositing/dispensing machine 30, information stored in the storage medium 42 of the storage cassette 40 is read by the reader writer 32*d*. Thus, for example, information (specifically, the number of banknotes and the number of coins for each denomination) on banknotes and coins which have been collected from the banknote handling device 22 and the coin handling device 24 and stored in the storage cassette 40 is managed by the controller 38 of the money depositing/dispensing machine 30.

Next, an operation (that is, operation indicated by reference numeral (b) in FIG. 1) performed by the money handling system 10 during the replenishing process will be described. Before the business hours of the store, a clerk in charge of a register performs dispensing of coins and banknotes (that is, banknotes and coins as change fund) to be stored as change in the money change machine 20, from the money depositing/dispensing machine 30. Specifically, the clerk in charge of the register mounts the empty storage cassette 40 to the cassette mounting unit 32*c* of the banknote handling device 32, whereby banknotes as change fund are fed out from the storage/feeding unit 32*a* of the banknote handling device 32 and stored in the storage cassette 40. The clerk in charge of the register causes the coin handling device 34 to dispense coins stored in the storage/feeding unit 34*a*. The clerk in charge of the register stores the coins as change fund dispensed from the coin handling device 34, in the storage case (not shown), with her/his hands. The clerk in charge of the register takes out coin rolls stored in the coin roll storing device 36, with her/his hands, and stores the taken coin rolls in the storage case with her/his hands. When banknotes and coins as change fund are dispensed from the banknote handling device 32, the coin handling device 34, and the like, information (specifically, the number of the banknotes and the number of the coins for each denomination) on banknotes and coins dispensed from the banknote handling device 32 and the coin handling device 34 are written into the storage medium 42 of the storage cassette 40 by the reader writer 32*d*. The identification number of the settlement place at which the money change machine 20 to be replenished with the banknotes and the coins dispensed from the banknote handling device 32 and the coin handling device 34 is installed, and the identification number of the clerk in charge of the register who has performed the dispensing may be written into the storage medium 42 of the storage cassette 40 by the reader writer 32*d*.

When the banknotes and coins as change fund have been stored in the storage cassette 40 and the storage case, the clerk in charge of the register conveys the storage cassette 40 and the storage case from the back office region 14 to the front office region 12. Thereafter, the clerk in charge of the register mounts the storage cassette 40 to the cassette mounting unit 22*c* in the banknote handling device 22 of the money change machine 20. Thus, the banknotes as change fund stored in the storage cassette 40 are fed out from the storage cassette 40, sent into the housing of the banknote handling device 22, and stored in the storage/feeding unit 22*a* of the banknote handling device 22. The clerk in charge of the register takes out coins as change fund from the storage case, and performs depositing of the taken coins in the coin handling device 24. Thus, the coins as change fund dispensed from the coin handling device 34 are stored in the storage/feeding unit 24*a* of the coin handling device 24. The clerk in charge of the register takes out coin rolls as change fund, from the storage case, with her/his hands, and stores the taken coin rolls in the coin roll storing device 26. In the present embodiment, when the storage cassette 40 has been mounted to the cassette mounting unit 22*c* in the banknote handling device 22 of the money change machine 20, information stored in the storage medium 42 of the storage cassette 40 is read by the reader writer 22*d*. Thus, for example, information (specifically, the number of banknotes and the number of coins for each denomination) on banknotes and coins as change fund which are dispensed from the banknote handling device 32 and the coin handling device 34 and stored in the storage cassette 40 is managed by the controller 28 of the money change machine 20.

In the money handling system 10 according to the present embodiment, a spare storage cassette 40 (that is, the storage cassette 40 which does not correspond to any of the money change machines 20) is used in addition to the storage cassettes 40 used so as to correspond to the respective money change machines 20. In a case where, when money is collected from each money change machine 20 and deposited in the money depositing/dispensing machine 30, the storage/feeding unit 32*a* in the banknote handling device 32 of the money depositing/dispensing machine 30 is in a full state or a nearly full state and banknotes can no longer be stored in the storage/feeding unit 32*a*, such a spare storage cassette 40 is used for storage so as to temporarily store banknotes stored in the storage/feeding unit 32*a*. Such a technical matter will be described below in detail.

In the money handling system 10 according to the present embodiment, an entire collection process in which all the money is collected from the plurality of the money change machines 20, and deposited in the money depositing/dispensing machine 30 may be periodically performed. In a case where, during such an entire collection process, the storage/feeding unit 32*a* in the banknote handling device 32 of the money depositing/dispensing machine 30 has been in a full state or a nearly full state and banknotes can no longer be stored in the storage/feeding unit 32*a*, an operation of feeding out banknotes from the storage cassette 40 mounted to the cassette mounting unit 32*c* of the banknote handling device 32 and sending the banknotes to the storage/feeding unit 32*a* is stopped. Information indicating that the storage/feeding unit 32*a* is in a full state or a nearly full state is displayed on the operation/display unit 39*a* of the money depositing/dispensing machine 30. A screen for prompting the operator to dismount the storage cassette 40 for collection, from the cassette mounting unit 32*c* of the banknote handling device 32, and mount the spare storage cassette 40 to the cassette mounting unit 32*c* is displayed on the operation/display unit 39*a* of the money depositing/dispensing machine 30. Thereafter, when the operator such as the clerk in charge of the register dismounts the storage cassette 40 for collection, from the cassette mounting unit 32*c* of the banknote handling device 32, and mounts the empty spare storage cassette 40 to the cassette mounting unit 32*c*, banknotes are fed out from the storage/feeding unit 32*a* and stored in the storage cassette 40. As indicated by reference numeral (c) in FIG. 1, the operator dismounts the storage cassette 40 from the cassette mounting unit 32*c*. Thus, the storage cassette 40 storing banknotes is retained in the back office region 14. In such an operation, the storage/feeding unit 32*a* of the banknote handling device 32 can have an excess space and the entire collection process can be continuously performed.

In the money handling system 10 according to the present embodiment, while banknotes and coins as change fund with which each money change machine 20 is to be replenished are being dispensed from the money depositing/dispensing machine 30, the storage/feeding unit 32*a* of the banknote handling device 32 may become empty. In such a case, the operator such as the clerk in charge of the register mounts the storage cassette 40, for storage, which stores the banknotes and has been retained in the back office region 14, to the cassette mounting unit 32*c* of the banknote handling device 32 as indicated by reference numeral (d) in FIG. 1. Thus, banknotes are fed out from the storage cassette 40 and sent to the storage/feeding unit 32*a*, whereby the replenishing process of replenishing each money change machine 20 with money as the change fund can be continuously performed.

In the present embodiment, the usage determination unit 50 determines the usage of the storage cassette 40 mounted to the cassette mounting unit 32*c*, according to a storing state of banknotes in the storage/feeding unit 32*a*. The usage of the storage cassette 40 which is determined by the usage determination unit 50 is written into the storage medium 42 of the storage cassette 40 by the reader writer 32*d*. Specifically, the usage of the storage cassette 40 includes collection, replenishment, and storage. The usages of the storage cassettes 40 used so as to correspond to the respective money change machines 20 are generally collection or replenishment. Meanwhile, the usage of the spare storage cassette 40 is generally storage.

More specifically, in the above-described collection process, in a case where the empty storage cassette 40 is mounted to the cassette mounting unit 22*c* in the banknote handling device 22 of the money change machine 20, and the operator thereafter inputs an instruction for performing the collection process through the operation/display unit 29*a*, the usage of the storage cassette 40 is written as collection into the storage medium 42 of the storage cassette 40 by the reader writer 22*d*. In the banknote handling device 22, banknotes as proceeds from sales are fed out from the storage/feeding unit 22*a*, and the banknote having been fed out are stored in the storage cassette 40. Thereafter, in a case where the storage cassette 40 is dismounted from the cassette mounting unit 22*c* and conveyed from the front office region 12 to the back office region 14, and the storage cassette 40 is thereafter mounted to the cassette mounting unit 32*c* in the banknote handling device 32 of the money depositing/dispensing machine 30, when the information indicating that the usage of the storage cassette 40 is collection is read from the storage medium 42 of the storage cassette 40 by the reader writer 32*d*, banknotes as proceeds from sales are sent from the storage cassette 40 to the storage/feeding unit 32*a* (see FIG. 6).

In the above-described replenishing process, in a case where the empty storage cassette 40 is mounted to the cassette mounting unit 32*c* in the banknote handling device 32 of the money depositing/dispensing machine 30, and the operator thereafter inputs an instruction for performing the replenishing process to the operation/display unit 39*a*, the usage of the storage cassette 40 is written as replenishment into the storage medium 42 of the storage cassette 40 by the reader writer 32*d*. In the banknote handling device 32, banknotes as change fund are fed out from the storage/feeding unit 32*a*, and the banknotes having been fed out are stored in the storage cassette 40 (see FIG. 6). Thereafter, in a case where the storage cassette 40 is dismounted from the cassette mounting unit 32*c* and conveyed from the back office region 14 to the front office region 12, and the storage cassette 40 is thereafter mounted to the cassette mounting unit 22*c* in the banknote handling device 22 of the money change machine 20, when information indicating that the usage of the storage cassette 40 is replenishment is read from the storage medium 42 of the storage cassette 40 by the reader writer 22*d*, banknotes as change fund are sent from the storage cassette 40 to the storage/feeding unit 22*a*.

In a case where the storage/feeding unit 32*a* in the banknote handling device 32 of the money depositing/dispensing machine 30 is in a full state or a nearly full state and banknotes can no longer be stored in the storage/feeding unit 32*a*, when the empty storage cassette 40 is mounted to the cassette mounting unit 32*c*, the usage determination unit 50 determines, as storage, the usage of the storage cassette 40 mounted to the cassette mounting unit 32*c*. In this case, the usage of the storage cassette 40 is written as storage into the storage medium 42 of the storage cassette 40 by the reader writer 32*d*. After the usage of the storage cassette 40 is written as storage into the storage medium 42 of the storage cassette 40 by the reader writer 32*d*, banknotes are fed out from the storage/feeding unit 32*a* in the banknote handling device 32, and the banknotes having been fed out are stored in the storage cassette 40 (see FIG. 6). Thus, the controller 38 performs control such that banknotes are sent from the storage/feeding unit 32*a* to the empty storage cassette 40 mounted to the cassette mounting unit 32*c* according to a storing state of banknotes in the storage/feeding unit 32*a*. Thereafter, the replenishing process is performed by the money depositing/dispensing machine 30 and the storage/feeding unit 32*a* has an excess space. Thereafter, when the storage cassette 40, for storage, which stores banknotes is mounted to the cassette mounting unit 32*c* in the banknote handling device 32 of the money depositing/dispensing machine 30, information on the usage of the storage cassette 40 is read from the storage medium 42 of the storage cassette 40 by the reader writer 32*d*. When the usage of the storage cassette 40 is read as storage by the reader writer 32*d*, banknotes are fed out from the storage cassette 40, and the banknotes having been fed out are stored in the storage/feeding unit 32*a* (FIG. 6).

In the present embodiment, instead of collection and replenishment being separately set as the usage of the storage cassette 40, replenishment collection may be set as the usage. An operation performed when the storage cassette 40 is mounted to the cassette mounting unit 32*c* in the banknote handling device 32 of the money depositing/dispensing machine 30 in the case of the usage, of the storage cassette 40, which is stored in the storage medium 42 of the storage cassette 40 being replenishment collection, will be described below. In a case where the storage cassette 40 is mounted to the cassette mounting unit 32*c* in the banknote handling device 32 of the money depositing/dispensing machine 30, and the usage of the storage cassette 40 which is read from the storage medium 42 of the storage cassette 40 by the reader writer 32*d* is replenishment collection, when banknotes are stored in the storage cassette 40, the storage cassette 40 is considered to store banknotes collected from the banknote handling device 22 of the money change machine 20, so that banknotes are fed out from the storage cassette 40 and sent to the storage/feeding unit 32*a*. Meanwhile, in a case where the storage cassette 40 is mounted to the cassette mounting unit 32*c* in the banknote handling device 32 of the money depositing/dispensing machine 30, and the usage of the storage cassette 40 which is read from the storage medium 42 of the storage cassette 40 by the reader writer 32*d* is replenishment collection, when no banknotes are stored in the storage cassette 40, the storage cassette 40 is considered to be used for replenishing the money change machine 20 with banknotes as change fund, so that banknotes are fed out from the storage/feeding unit 32*a* and sent to the storage cassette 40 (see FIG. 6).

In the present embodiment, the spare storage cassette 40 (that is, the storage cassette 40 which does not correspond to any of the money change machines 20) may be used in the replenishing process for replenishing each of the money change machines 20 with money as change fund. Specifically, in a case where the storage cassette 40 is mounted to the cassette mounting unit 32*c* in the banknote handling device 32 of the money depositing/dispensing machine 30, when the operator makes an input indicating that the usage of the storage cassette 40 is replenishment by the spare through the operation/display unit 39*a*, information indicating that the usage of the storage cassette 40 is replenishment by the spare is written into the storage medium 42 of the storage cassette 40 by the reader writer 32*d*. Information (specifically, information on, for example, the number of banknotes with which each banknote handling device 22 is to be replenished, for each denomination) on money as change fund with which each money change machine 20 is to be replenished is also written into the storage medium 42 of the storage cassette 40 by the reader writer 32*d*. Banknotes as change fund with which each money change machine 20 is to be replenished are fed out from the storage/feeding unit 32*a* and sent to the storage cassette 40. Thereafter, as indicated by reference numeral (e) in FIG. 7, the storage cassette 40 which stores banknotes as change fund with which each money change machine 20 is to be replenished is conveyed from the back office region 14 to the front office region 12, and mounted to the cassette mounting unit 22*c* in the banknote handling device 22 of each money change machine 20, and, thus, the storage/feeding unit 22*a* in the banknote handling device 22 of each money change machine 20 is replenished with banknotes as change fund from the storage cassette 40 More specifically, when the storage cassette 40 is mounted to the cassette mounting unit 22*c* in the banknote handling device 22 of the money change machine 20, and information indicating that the usage of the storage cassette 40 is replenishment by the spare is read from the storage medium 42 of the storage cassette 40 by the reader writer 22*d*, a predetermined number of banknotes are fed out from the storage cassette 40 based on the information, on money as change fund, which is read from the storage medium 42 by the reader writer 22*d*, and sent to the storage/feeding unit 22*a*.

Figures 7, 8:
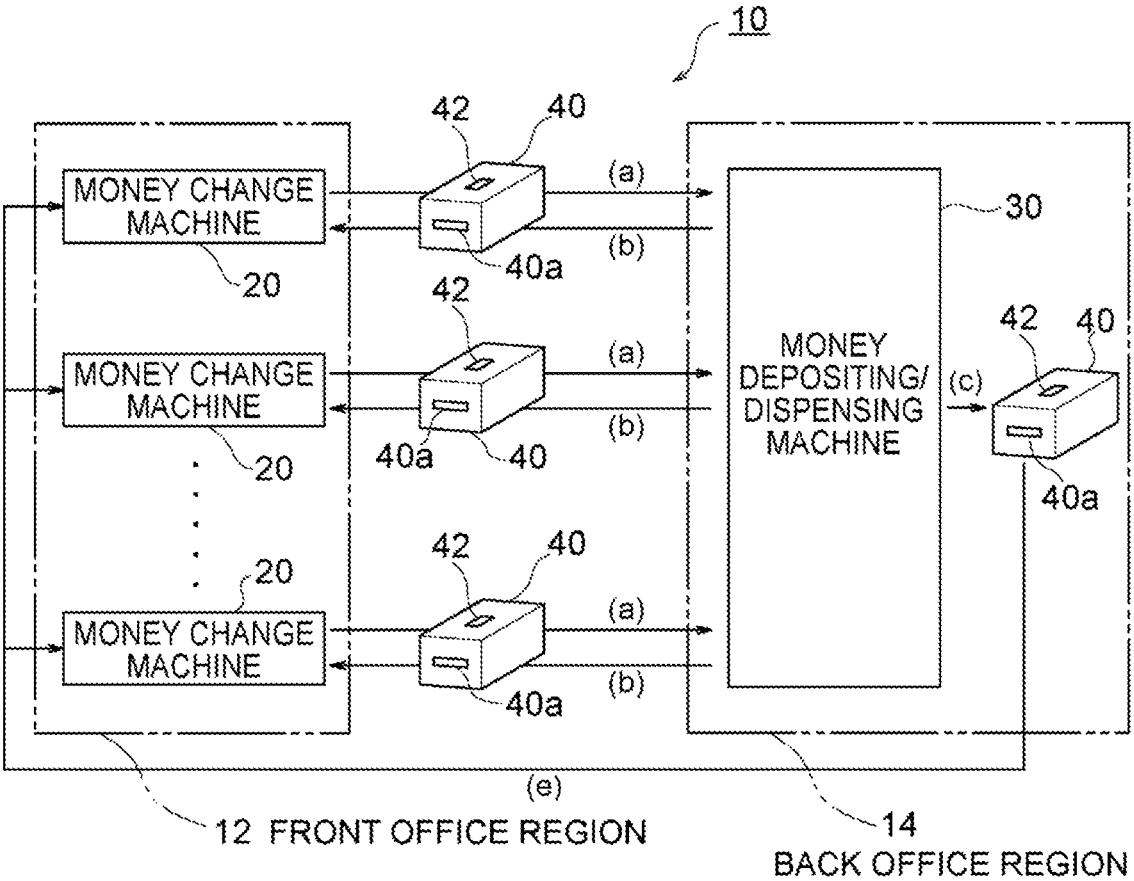
FIG. 7 illustrates an operation for replenishing each money change machine with money by using a spare storage cassette in the money handling system shown in FIG. 1.
FIG. 8 shows a table representing information to be stored in a storage medium disposed in the storage cassette in a collection process in which banknotes are collected by the money handling system shown in FIG. 1.

FIG. 7 shows an operation of replenishing a plurality of the money change machines 20 with banknotes as change fund by using a single storage cassette 40 for replenishment by the spare. However, the money handling system 10 according to the present embodiment is not limited to such an aspect. In another example of the money handling system 10 according to the present embodiment, a single money change machine 20 may be replenished with banknotes as change fund from a single storage cassette 40 for replenishment by the spare. In this case, when the storage cassette 40 is mounted to the cassette mounting unit 32*c* in the banknote handling device 32 of the money depositing/dispensing machine 30, information (specifically, information on, for example, the number of banknotes with which the one banknote handling device 22 is to be replenished, for each denomination) on money as change fund with which the one money change machine 20 is to be replenished is written into the storage medium 42 of the storage cassette 40 by the reader writer 32*d*.

In the money handling system 10 according to the present embodiment, the storage cassette 40 (that is, the storage cassette 40 used for collection or replenishment) which is used for the corresponding money change machine 20 may be used also as the spare storage cassette 40. That is, in a case where, when the storage cassette 40 of which the usage is stored as collection or replenishment in the storage medium 42 is mounted to the cassette mounting unit 32*c* in the banknote handling device 32 of the money depositing/dispensing machine 30, banknotes can no longer be stored in the storage/feeding unit 32*a* due to the storage/feeding unit 32*a* being in a full state or a nearly full state, the usage of the storage cassette 40 mounted to the cassette mounting unit 32*c* is changed from collection or replenishment to storage by the usage determination unit 50. In this case, the usage of the storage cassette 40 is written as storage into the storage medium 42 of the storage cassette 40 by the reader writer 32*d*. After the usage of the storage cassette 40 is written as storage into the storage medium 42 of the storage cassette 40 by the reader writer 32*d*, banknotes are fed out from the storage/feeding unit 32*a* and sent to the storage cassette 40.

In still another example of the money handling system 10 shown in FIG. 1 to FIG. 10, when the empty storage cassette 40 is mounted to the cassette mounting unit 32*c* in the banknote handling device 32 of the money depositing/dispensing machine 30, the usage determination unit 50 may determine, as storage, the usage of the storage cassette 40 mounted to the cassette mounting unit 32*c*, regardless of a storing state of banknotes in the storage/feeding unit 32*a*. In this case, in a case where the operator wants to perform the replenishing process, when the operator inputs an instruction for the replenishing process through the operation/display unit 39*a*, the usage of the storage cassette 40 mounted to the cassette mounting unit 32*c* is changed from storage to replenishment by the usage determination unit 50.

In the money handling system 10 according to the present embodiment, when a large number of banknotes are to be collected from the money change machine 20, a plurality of the storage cassettes 40 may be used in one transaction (in other words, collection process performed at one time). In this case, after the plurality of the storage cassettes 40 to which banknotes have been sent from the banknote handling device 22 (specifically, the storage/feeding unit 22*a*) in the money change machine 20 are conveyed to the money depositing/dispensing machine 30, banknotes are stored into the banknote handling device 32 (specifically, the storage/feeding unit 32*a*) of the money depositing/dispensing machine 30 from the storage cassettes 40 one by one in the money depositing/dispensing machine 30. In a conventional money handling system, since the money depositing/dispensing machine cannot obtain the number of the storage cassettes which are used in the collection process of collecting banknotes from the money change machine, the operator may forget to mount one or more of the plurality of the storage cassettes to the money depositing/dispensing machine. In this case, a problem may arise that an error in calculation occurs in the money depositing/dispensing machine. Meanwhile, in the present embodiment, the determination unit 51 determines whether or not banknotes have been sent into the banknote handling device 32 (specifically, the storage/feeding unit 32*a*) in the money depositing/dispensing machine 30 from all the storage cassettes 40 to which banknotes have been sent from the banknote handling device 22 (specifically, the storage/feeding unit 22*a*) of the money change machine 20 when the plurality of the storage cassettes 40 are used in one collection process. This inhibits the operator from forgetting to mount one of more of the plurality of the storage cassettes 40 to the banknote handling device 32 of the money depositing/dispensing machine 30. Therefore, an error in calculation can be prevented from occurring in the money depositing/dispensing machine 30. Such a technical matter will be described below in detail.

In the money handling system 10, in a case where the collection process is performed using the plurality of the storage cassettes 40, when a certain storage cassette 40 (the empty storage cassette 40) among the plurality of the storage cassettes 40 is mounted to the cassette mounting unit 22*c* of the banknote handling device 22, and banknotes, as proceeds from sales, which are stored in the storage/feeding unit 22*a* of the banknote handling device 22 have been stored in this storage cassette 40, information indicating whether or not the storage cassette 40 mounted to the cassette mounting unit 22*c* is the last cassette, and information on the number indicating the order in which the storage cassette 40 has been used in the collection process are written into the storage medium 42 of the storage cassette 40 by the reader writer 22*d*. FIG. 8 shows in detail such information written into the storage medium 42 of the storage cassette 40. As described above, identification information (specifically, identification number of the storage cassette 40) of the storage cassette 40 is stored in the storage medium 42. Information indicating whether or not the storage cassette 40 mounted to the cassette mounting unit 22*c* is the last cassette is written into the storage medium 42 by the reader writer 22*d*. Specifically, as shown in FIG. 8, in the storage medium 42, information of "0" is written when the storage cassette 40 is not the last cassette, and information of "1" is written when the storage cassette 40 is the last cassette (in the example shown in FIG. 8, the storage cassette 40 having the identification number: 001 has been mounted last to the cassette mounting unit 22*c* of the banknote handling device 22 in the collection process). As shown in FIG. 8, information on the number indicating the order in which the storage cassette 40 has been used in the collection process is written into the storage medium 42 by the reader writer 22*d* (in the example shown in FIG. 8, the storage cassette 40 having the identification number: 001 has been mounted fifth to the cassette mounting unit 22*c* of the banknote handling device 22 in the collection process, and this storage cassette 40 has been mounted last to the cassette mounting unit 22*c* in one collection process).

Figure 9:
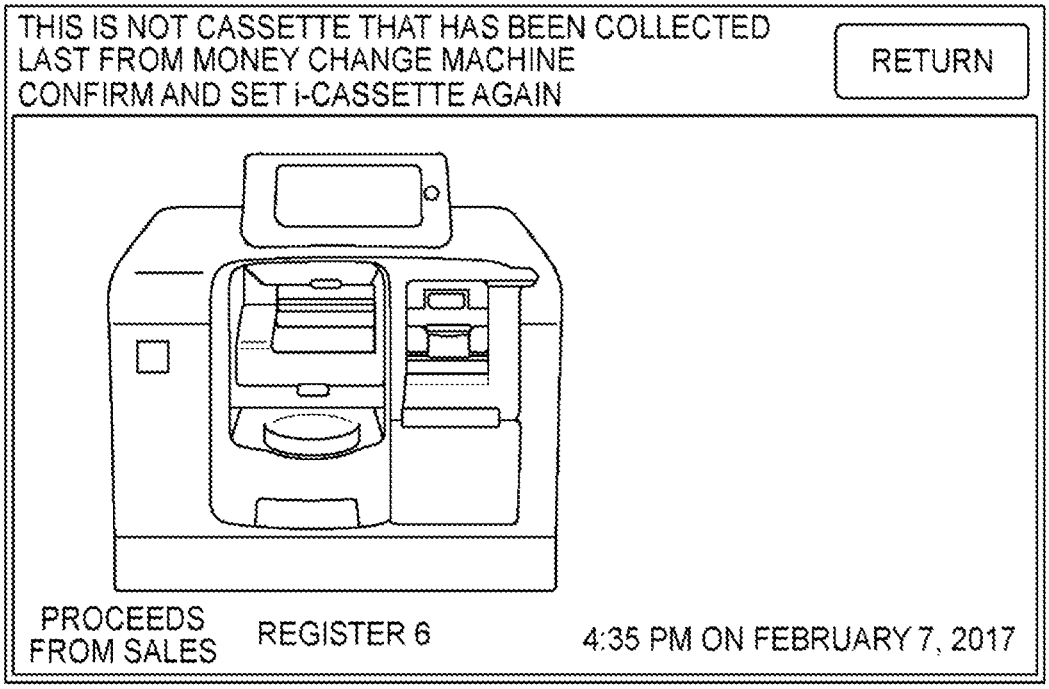
FIG. 9 illustrates a screen displayed on an operation/display unit of the money depositing/dispensing machine in the collection process in which banknotes are collected in the money handling system shown in FIG. 1.

The plurality of the storage cassettes 40 are conveyed from the front office region 12 to the back office region 14 by the clerk in charge of the register, and the storage cassettes 40 are mounted one by one to the cassette mounting unit 32*c* in the banknote handling device 32 of the money depositing/dispensing machine 30. In the present embodiment, an operation rule in which the storage cassette 40 to which banknotes have been sent last from the banknote handling device 22 of the money change machine 20 is to be firstly mounted to the cassette mounting unit 32*c* in the banknote handling device 32 of the money depositing/dispensing machine 30 is adopted. Specifically, when the storage cassette 40 is mounted to the cassette mounting unit 32*c* in the banknote handling device 32 of the money depositing/dispensing machine 30, information is read from the storage medium 42 disposed in the storage cassette 40 by the reader writer 32*d*, and information (that is, information indicating whether or not banknotes have been sent last from the banknote handling device 22 of the money change machine 20) indicating whether or not the current storage cassette 40 is the storage cassette 40 which has been mounted last to the cassette mounting unit 22*c* in the banknote handling device 22 of the money change machine 20 is also read from the storage medium 42 by the reader writer 32*d*. In a case where the storage cassette 40 which has been firstly mounted to the cassette mounting unit 32*c* in the banknote handling device 32 of the money depositing/dispensing machine 30 is not the storage cassette 40 which has been mounted last to the cassette mounting unit 22*c* in the banknote handling device 22 of the money change machine 20, the mounting order determination unit 52 determines that an error occurs in the order in which the storage cassette 40 is mounted to the banknote handling device 32 in the money depositing/dispensing machine 30. When the mounting order determination unit 52 determines that an error occurs in the order in which the storage cassette 40 is mounted to the banknote handling device 32 in the money depositing/dispensing machine 30, information indicating that the storage cassette 40 mounted to the cassette mounting unit 32*c* of the banknote handling device 32 is not the storage cassette 40 which has been collected last from the money change machine 20 is displayed on the operation/display unit 39*a* as shown in FIG. 9. A message for prompting the operator to re-mount another storage cassette 40 to the cassette mounting unit 32*c* of the banknote handling device 32 is displayed on the operation/display unit 39*a*. Thus, the operator is allowed to know that an error occurs in the order in which the storage cassette 40 is mounted to the banknote handling device 32 in the money depositing/dispensing machine 30.

Figure 10:
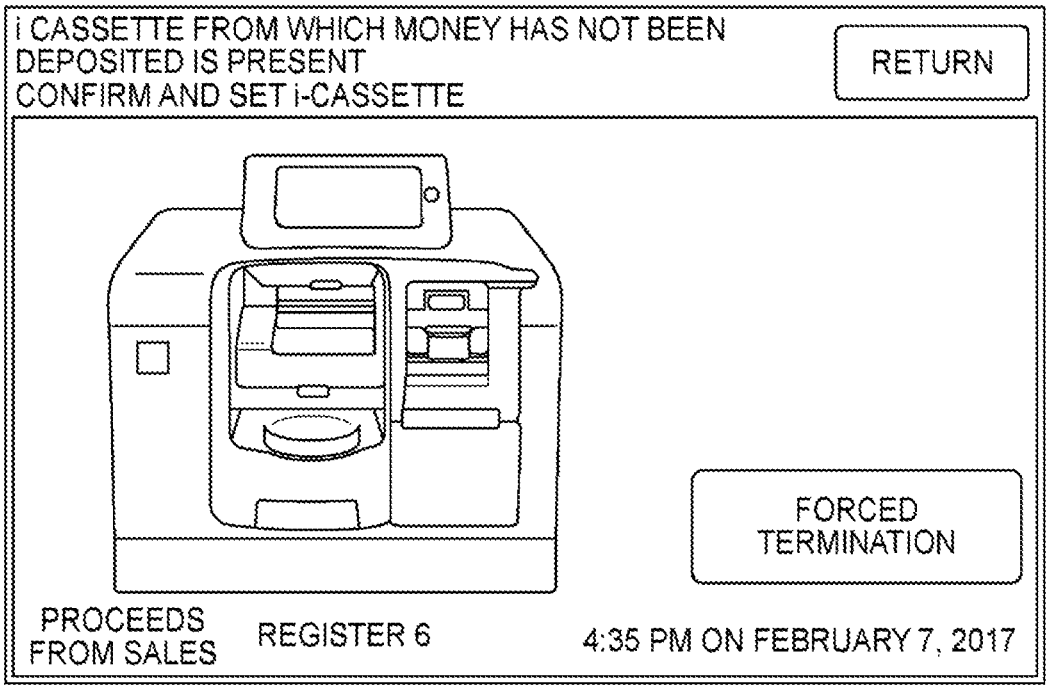
FIG. 10 illustrates a screen displayed on the operation/display unit of the money depositing/dispensing machine in the collection process in which banknotes are collected in the money handling system shown in FIG. 1.
Figure 11:
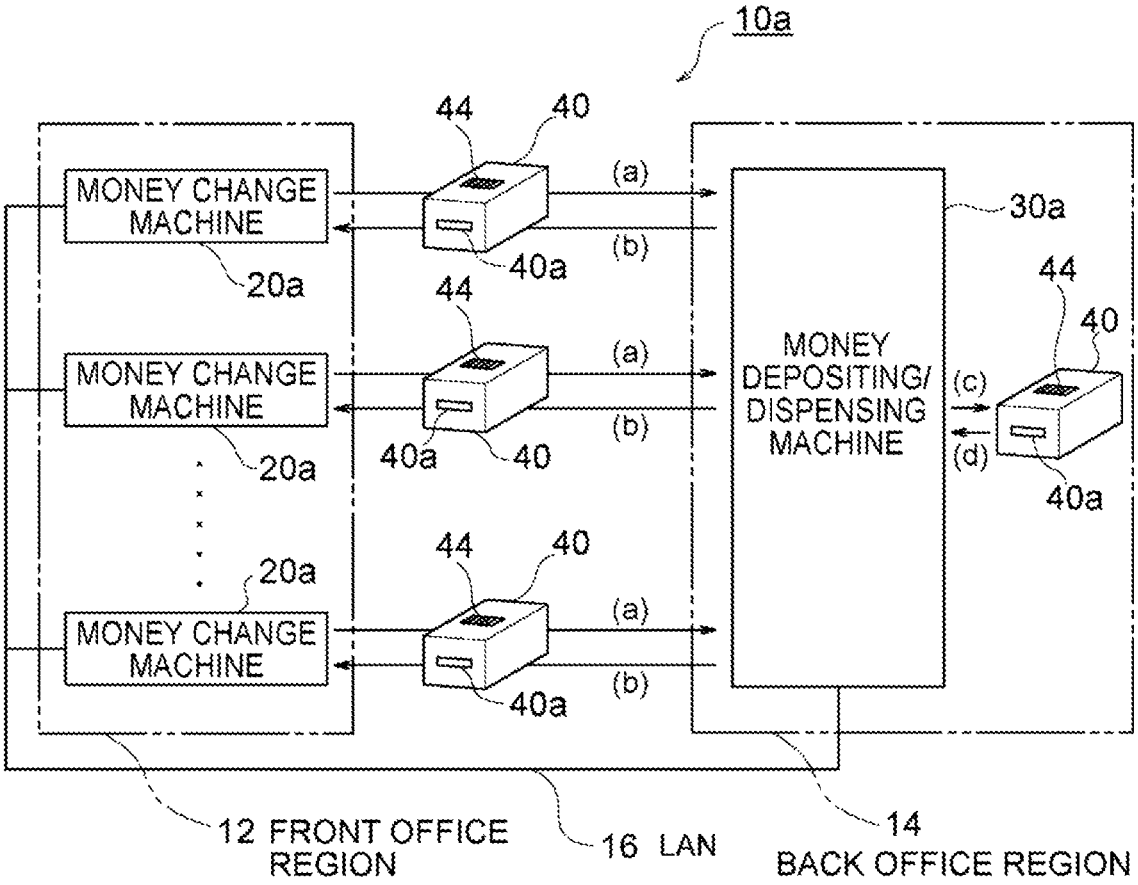
FIG. 11 is a schematic diagram illustrating a schematic configuration of another example of a money handling system according to an embodiment of the present invention.

Meanwhile, in a case where the storage cassette 40 which has been firstly mounted to the cassette mounting unit 32*c* in the banknote handling device 32 of the money depositing/dispensing machine 30 is the storage cassette 40 which has been mounted last to the cassette mounting unit 22*c* in the banknote handling device 22 of the money change machine 20, the mounting order determination unit 52 determines that the order in which the storage cassette 40 is mounted to the banknote handling device 32 in the money depositing/dispensing machine 30 is correct. In this case, information on the number indicating the order in which the storage cassette 40 has been used in the collection process is read from the storage medium 42 of the storage cassette 40 by the reader writer 32*d*, whereby the controller 38 can obtain information on the number of the storage cassettes 40 which have been used in the collection process. That is, in a case where the storage cassette 40 for which the information as shown in FIG. 8 is stored in the storage medium 42 is mounted to the cassette mounting unit 32*c* in the banknote handling device 32 of the money depositing/dispensing machine 30, the mounting order determination unit 52 determines that the order in which the storage cassette 40 is mounted to the banknote handling device 32 in the money depositing/dispensing machine 30 is correct, and the controller 38 obtains information indicating that the five storage cassettes 40 have been used in the collection process. Thereafter, the clerk in charge of the register mounts the second and subsequent storage cassettes 40 to the cassette mounting unit 32*c* in the banknote handling device 32 of the money depositing/dispensing machine 30, and banknotes as proceeds from sales are sent from the storage cassettes 40 to the storage/feeding unit 32*a*. In a case where the storage cassette 40 which has not been mounted to the cassette mounting unit 32*c* in the banknote handling device 32 of the money depositing/dispensing machine 30 remains, a screen as shown in FIG. 10 is displayed on the operation/display unit 39*a*. Specifically, information indicating that the storage cassette 40 which has not been mounted to the cassette mounting unit 32*c* in the banknote handling device 32 of the money depositing/dispensing machine 30 is present is displayed on the operation/display unit 39*a*, and a message for prompting the operator to mount, to the cassette mounting unit 32*c*, the storage cassette 40 which has not been mounted is displayed on the operation/display unit 39*a*. Thus, the operator is allowed to know that, among the plurality of the storage cassettes 40 to which banknotes have been sent from the storage/feeding unit 22*a* in the banknote handling device 22 of the money change machine 20, the storage cassette 40 which has not been mounted to the cassette mounting unit 32*c* of the banknote handling device 32 is present. When all the plurality of the storage cassettes 40 to which banknotes have been sent from the storage/feeding unit 22*a* in the banknote handling device 22 of the money change machine 20 have been mounted to the cassette mounting unit 32*c* in the banknote handling device 32 of the money depositing/dispensing machine 30, and all the banknotes have been sent from each storage cassette 40 to the storage/feeding unit 32*a* of the banknote handling device 32, the collection process using the plurality of the storage cassettes 40 ends.

Thus, the determination unit 51 determines whether or not banknotes have been sent from all the storage cassettes 40 to which banknotes have been sent from the banknote handling device 22 (specifically, the storage/feeding unit 22*a*) in the money change machine 20, into the banknote handling device 32 (specifically, the storage/feeding unit 32*a*) in the money depositing/dispensing machine 30 when the plurality of the storage cassettes 40 are used in one collection process. In a case where a plurality of the money change machines 20 are disposed as shown in FIG. 1, the determination unit 51 determines, for each money change machine 20, whether or not banknotes have been sent from all the storage cassettes 40 to which banknotes have been sent from the banknote handling device 22 in the money change machine 20, into the banknote handling device 32 in the money depositing/dispensing machine 30.

In the present embodiment, in a case where the collection process is performed using the plurality of the storage cassettes 40, while the storage cassettes 40 are being mounted one by one to the cassette mounting unit 32*c* in the banknote handling device 32 of the money depositing/dispensing machine 30, the depositing of banknotes in the banknote handling device 32 can be stopped. Specifically, as shown in FIG. 10, when the operator such as the clerk in charge of the register presses a "forced termination" button displayed on the operation/display unit 39*a* in a state where the storage cassette 40 which has not been mounted to the cassette mounting unit 32*c* in the banknote handling device 32 of the money depositing/dispensing machine 30 remains, depositing of banknotes from the storage cassettes 40 in the banknote handling device 32 is stopped. In this case, the controller 38 outputs information on the storage cassette 40 to which banknotes have been sent from the banknote handling device 22 (specifically, the storage/feeding unit 22*a*) of the money change machine 20 and which has not sent the banknotes into the banknote handling device 32 (specifically, the storage/feeding unit 32*a*) of the money depositing/dispensing machine 30, and the outputted information is displayed on the operation/display unit 39*a*. Specifically, for example, information on the number of the storage cassettes 40 which have not been mounted to the cassette mounting unit 32*c* in the banknote handling device 32 of the money depositing/dispensing machine 30 at a point in time when the collection process is stopped, and the identification information (specifically, identification numbers) of the storage cassettes 40 is displayed on the operation/display unit 39*a*. Information on banknotes stored in the storage cassettes 40 which have not been mounted to the cassette mounting unit 32*c* in the banknote handling device 32 of the money depositing/dispensing machine 30 may also be displayed on the operation/display unit 39*a*. Thus, when the collection process is stopped, the operator is allowed to recognize the number of the storage cassettes 40 which have not been mounted to the cassette mounting unit 32*c* in the banknote handling device 32 of the money depositing/dispensing machine 30 and the identification information of the storage cassettes 40.

The money handling system according to the present embodiment is not limited to the money handling system in which the storage medium 42 is disposed in the storage cassette 40 and the usage of the storage cassette 40 is stored in the storage medium 42 as shown in FIG. 1 to FIG. 10. As another exemplary money handling system of the present embodiment, a money handling system in which, instead of the storage medium 42, a recognition medium 44 such as a barcode is disposed in the storage cassette 40 as shown in FIG. 11 to FIG. 14, may be used. Such an aspect will be described below.

FIG. 11 to FIG. 14 illustrate a money handling system 10*a* according to another example of the present embodiment and a money change machine 20*a* and a money depositing/dispensing machine 30*a* which are disposed in the money handling system 10*a*. In the description of the money change machine 20*a* and the money depositing/dispensing machine 30*a* shown in FIG. 11 to FIG. 14, the same components as in the money change machine 20 and the money depositing/dispensing machine 30 shown in FIG. 1 to FIG. 10 are denoted by the same reference numerals, and the description thereof is omitted.

Figure 12:
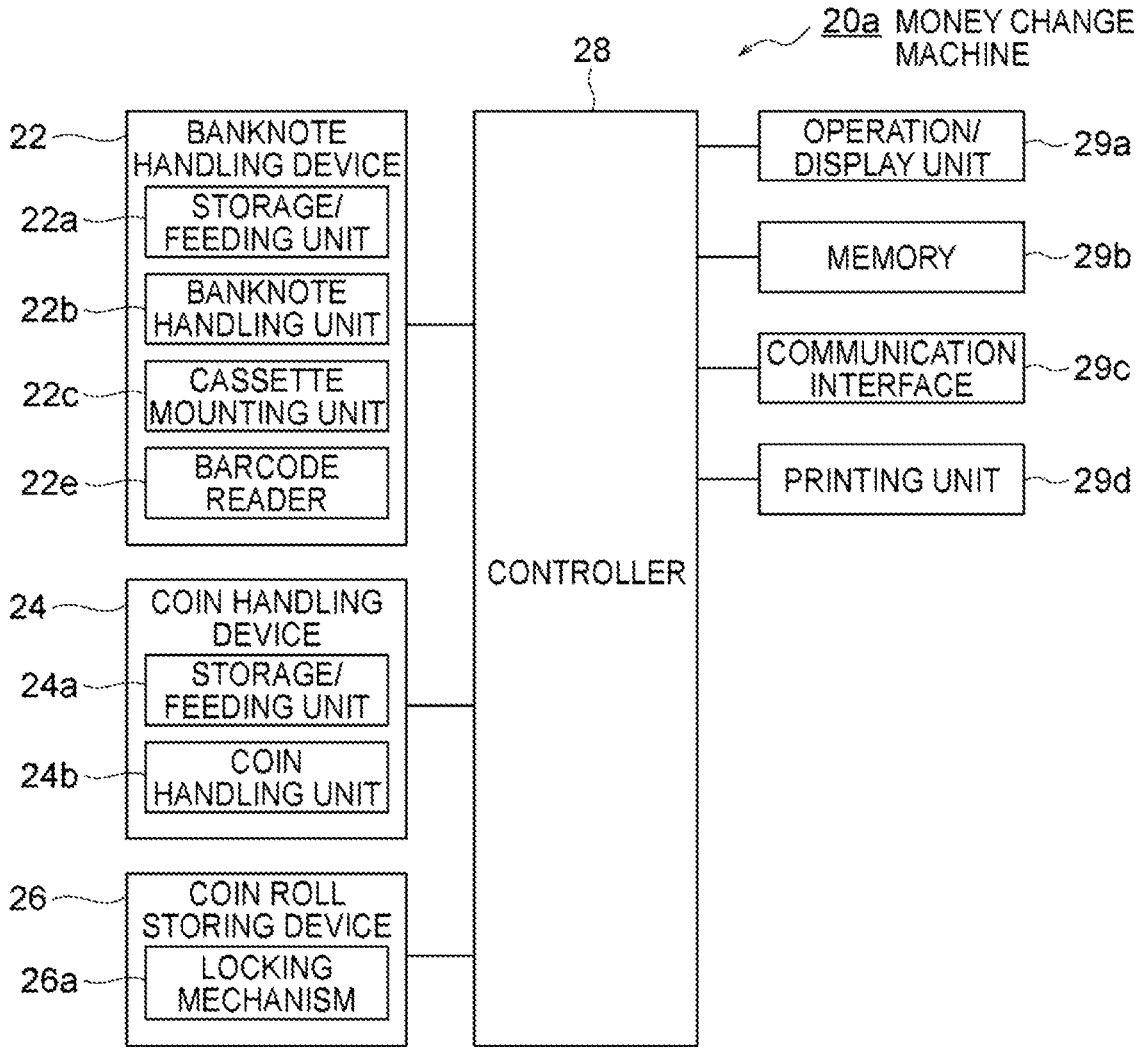
FIG. 12 is a functional block diagram illustrating a configuration of a control system of a money change machine of the money handling system shown in FIG. 11.
Figure 13:
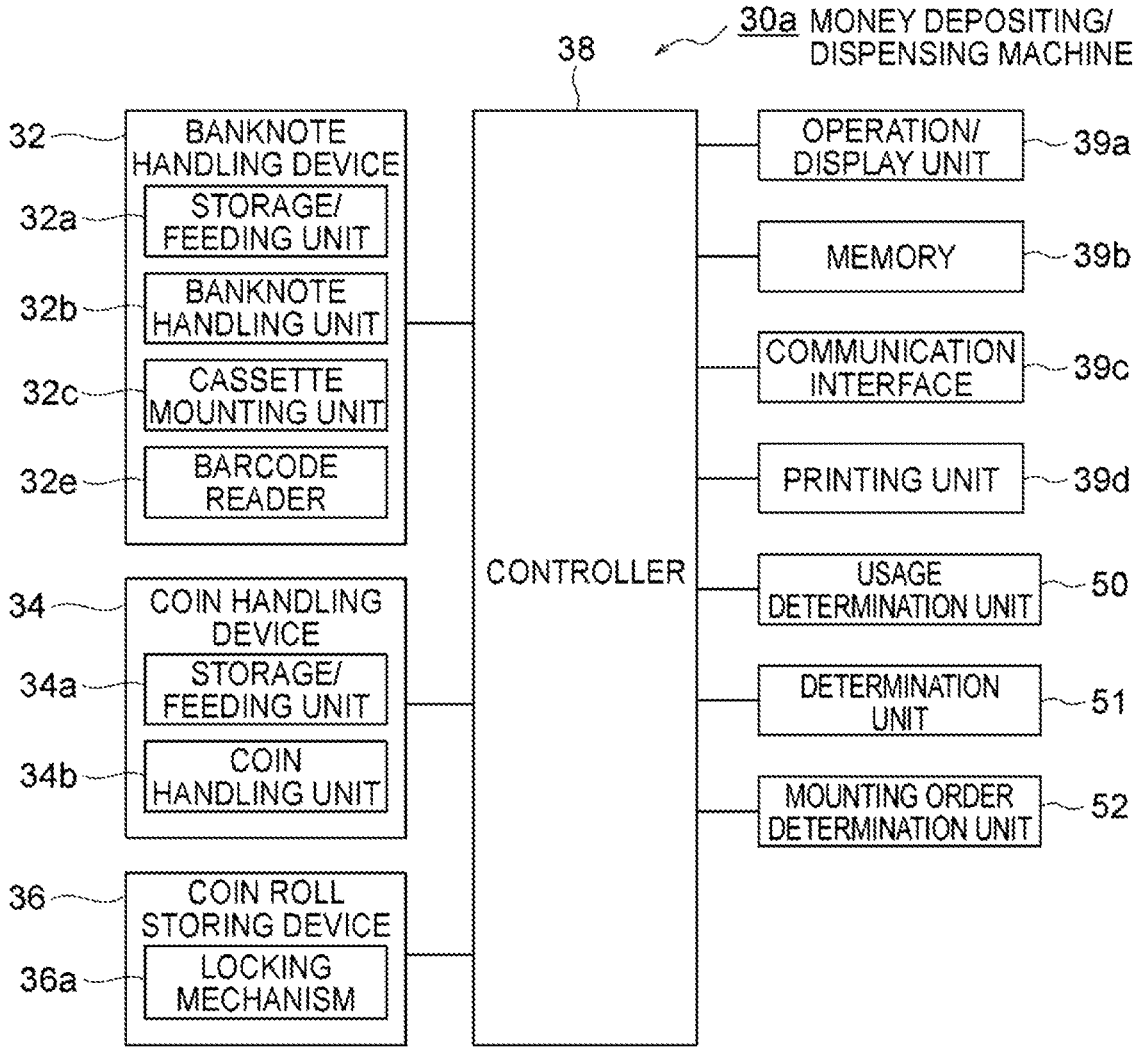
FIG. 13 is a functional block diagram illustrating a configuration of a control system of a money depositing/dispensing machine of the money handling system shown in FIG. 11.

As described above, in the money handling system 10*a* shown in FIG. 11 to FIG. 14, each of the plurality of the storage cassettes 40 used for delivering banknotes between the money change machine 20*a* and the money depositing/dispensing machine 30*a* has its corresponding identification information such as an identification number. Each of the storage cassettes 40 has the recognition medium 44 such as a barcode indicating the identification information of the storage cassette 40. As shown in FIG. 12, the banknote handling device 22 of the money change machine 20 has a barcode reader 22*e* for reading the identification information of the storage cassette 40 from the recognition medium 44 of the storage cassette 40 mounted to the cassette mounting unit 22*c*. Since the barcode reader 22*e* having such a configuration is disposed, when the storage cassette 40 is mounted to the cassette mounting unit 22*c* in the banknote handling device 22 of the money change machine 20, the identification information such as the identification number of the storage cassette 40 is read from the recognition medium 44 by the barcode reader 22*e* and transmitted to the controller 28. As shown in FIG. 13, the banknote handling device 32 of the money depositing/dispensing machine 30 also has a barcode reader 32*e* for reading the identification information of the storage cassette 40 from the recognition medium 44 of the storage cassette 40 mounted to the cassette mounting unit 32*c*. Since the barcode reader 32*e* having such a configuration is disposed, when the storage cassette 40 is mounted to the cassette mounting unit 32*c* in the banknote handling device 32 of the money depositing/dispensing machine 30, the identification information such as the identification number of the storage cassette 40 is read from the recognition medium 44 by the barcode reader 32*e* and transmitted to the controller 38.

In the money handling system 10*a* shown in FIG. 11 to FIG. 14, each money change machine 20*a* and the money depositing/dispensing machine 30*a* are connected so as to be communicable with each other via a local area network (LAN) 16 or the like in a wired or wireless manner. Thus, signal transmission and reception can be performed between the controller 28 of each money change machine 20*a* and the controller 38 of the money depositing/dispensing machine 30*a*. In the money handling system 10*a* shown in FIG. 11 to FIG. 14, each money change machine 20*a* and the money depositing/dispensing machine 30*a* may not necessarily be connected so as to be communicable with each other. In a modification of the money handling system 10*a* shown in FIG. 11 to FIG. 14, each money change machine 20*a* and the money depositing/dispensing machine 30*a* may not be connected so as to be communicable with each other.

In the money handling system 10*a* shown in FIG. 11 to FIG. 14, instead of the usage of each storage cassette 40 being written into the storage medium 42 disposed in the storage cassette 40, the usage of each storage cassette 40 is stored in the memory 39*b* of the money depositing/dispensing machine 30*a* so as to be associated with the identification number of the storage cassette 40. FIG. 14 shows a table representing a relationship, between the identification number of the storage cassette 40 and the usage of the storage cassette 40, which is stored in the memory 39*b* of the money depositing/dispensing machine 30*a*. As shown in FIG. 14, the usage of each storage cassette 40 is stored as collection, replenishment, or storage in the memory 39*b* so as to be associated with the identification number of the storage cassette 40. When the usage determination unit 50 determines the usage of the storage cassette 40, the usage of the storage cassette 40 stored in the memory 39*b* is rewritten.

More specifically, in the money handling system 10*a* shown in FIG. 11 to FIG. 14, in a case where, in the collection process, the empty storage cassette 40 has been mounted to the cassette mounting unit 22*c* in the banknote handling device 22 of the money change machine 20, and the operator thereafter inputs, through the operation/display unit 29*a*, an instruction for performing the collection process, the identification number of the storage cassette 40 which has been read from the recognition medium 44 by the barcode reader 22*e* and information indicating that the usage of the storage cassette 40 corresponding to this identification number is collection are transmitted from the controller 28 of the money change machine 20 to the controller 38 of the money depositing/dispensing machine 30. Among the usages of the storage cassettes 40 of the identification numbers stored in the memory 39*b*, the usage of the storage cassette 40, of the identification number, which has been mounted to the cassette mounting unit 22*c* in the banknote handling device 22 of the money change machine 20 is rewritten as collection. In the banknote handling device 22, banknotes as proceeds from sales are fed out from the storage/feeding unit 22*a*, and the banknotes having been fed out are stored in the storage cassette 40. Thereafter, the storage cassette 40 is dismounted from the cassette mounting unit 22*c* and conveyed from the front office region 12 to the back office region 14, and the storage cassette 40 is thereafter mounted to the cassette mounting unit 32*c* in the banknote handling device 32 of the money depositing/dispensing machine 30. In this case, when the usage of the storage cassette 40 corresponding to the storage cassette identification number which is read from the recognition medium 44 of the storage cassette 40 by the barcode reader 32*e* is determined as collection based on the information stored in the memory 39*b*, banknotes as proceeds from sales are sent from the storage cassette 40 to the storage/feeding unit 32*a* (see FIG. 6).

In the money handling system 10*a* shown in FIG. 11 to FIG. 14, in a case where, in the replenishing process, the empty storage cassette 40 is mounted to the cassette mounting unit 32*c* in the banknote handling device 32 of the money depositing/dispensing machine 30, and the operator thereafter inputs, through the operation/display unit 39*a*, an instruction for performing the replenishing process, the usage of the storage cassette 40, of the identification number, which is mounted to the cassette mounting unit 32*c* in the banknote handling device 32 of the money depositing/dispensing machine 30, among the usages of the storage cassettes 40 having the identification numbers stored in the memory 39*b*, is rewritten as replenishment. In the banknote handling device 32, banknotes as change fund are fed out from the storage/feeding unit 32*a* and banknotes having been fed out are stored in the storage cassette 40 (see FIG. 6). Thereafter, in a case where the storage cassette 40 is dismounted from the cassette mounting unit 32*c* and conveyed from the back office region 14 to the front office region 12, and the storage cassette 40 is thereafter mounted to the cassette mounting unit 22*c* in the banknote handling device 22 of the money change machine 20, the identification number of the storage cassette 40 is read from the recognition medium 44 of the storage cassette 40 by the barcode reader 22*e*. In a case where, by communication between the controller 28 of the money change machine 20 and the controller 38 of the money depositing/dispensing machine 30, the usage of the storage cassette 40 corresponding to the storage cassette identification number which is read from the recognition medium 44 of the storage cassette 40 by the barcode reader 22*e* is determined as replenishment based on information stored in the memory 39*b*, banknotes as change fund are sent from the storage cassette 40 to the storage/feeding unit 22*a*.

In a case where the storage/feeding unit 32*a* in the banknote handling device 32 of the money depositing/dispensing machine 30 is in a full state or a nearly full state, and banknotes can no longer be stored in the storage/feeding unit 32*a*, when the empty storage cassette 40 is mounted to the cassette mounting unit 32*c*, the usage determination unit 50 determines that the usage of the storage cassette 40 mounted to the cassette mounting unit 32*c* is storage. In this case, among the usages of the storage cassettes 40 having the identification numbers stored in the memory 39*b*, the usage of the storage cassette 40 corresponding to the storage cassette identification number which is read from the recognition medium 44 of the storage cassette 40 by the barcode reader 32*e* is rewritten as storage. After the usage of the storage cassette 40 which has the identification number stored in the memory 39*b* and is mounted to the cassette mounting unit 32*c* in the banknote handling device 32 of the money depositing/dispensing machine 30 is rewritten as storage, banknotes are fed out from the storage/feeding unit 32*a* in the banknote handling device 32, and banknotes having been fed out are stored in the storage cassette 40 (see FIG. 6). Thus, the controller 38 performs control so as to send banknotes from the storage/feeding unit 32*a* to the empty storage cassette 40 mounted to the cassette mounting unit 32*c* according to a storing state of banknotes in the storage/feeding unit 32*a*. Thereafter, in a case where an excess space is formed in the storage/feeding unit 32*a* by the replenishing process being performed by the money depositing/dispensing machine 30, and the storage cassette 40, for storage, which stores banknotes is thereafter mounted to the cassette mounting unit 32*c* in the banknote handling device 32 of the money depositing/dispensing machine 30, the identification number of the storage cassette 40 is read from the recognition medium 44 of the storage cassette 40 by the barcode reader 32*e*. When the usage of the storage cassette 40 corresponding to the read identification number of the storage cassette 40 is storage according to information stored in the memory 39*b*, banknotes are fed out from the storage cassette 40, and the banknotes having been fed out are stored in the storage/feeding unit 32*a* (FIG. 6).

In still another example of the money handling system of the present embodiment, in addition to the recognition medium 44 such as a barcode being disposed in the storage cassette 40 in place of the storage medium 42, the clerk in charge of the register may have a portable storage medium 46 such as an IC card as shown in FIG. 15 to FIG. 18. Such an aspect will be described below.

FIG. 15 to FIG. 18 illustrate a money handling system 10*b* according to another example of the present embodiment and a money change machine 20*b* and a money depositing/dispensing machine 30*b* which are disposed in the money handling system 10*b*. In the description of the money change machine 20*b* and the money depositing/dispensing machine 30*b* shown in FIG. 15 to FIG. 18, the same components as in the money change machine 20 and the money depositing/dispensing machine 30 shown in FIG. 1 to FIG. 10 are denoted by the same reference numerals, and the description thereof is omitted.

As described above, in the money handling system 10*b* shown in FIG. 15 to FIG. 18, the plurality of the storage cassettes 40 are used to deliver banknotes between the money change machine 20*b* and the money depositing/dispensing machine 30*b* and each storage cassette 40 has its corresponding identification information such as an identification number. The storage cassette 40 has the recognition medium 44 such as a barcode representing the identification information of the storage cassette 40. The clerk in charge of the register has the portable storage medium 46 such as an IC card. In the portable storage medium 46, for example, identification information such as the identification number of the storage cassette 40 used in the collection process and the replenishing process, information (specifically, information on the number of banknotes for each denomination, and the like) on banknotes stored in the storage cassette 40 used in the collection process and the replenishing process, and identification information of the money change machine 20*b* for which the collection process and the replenishing process are performed, are stored in addition to the identification information of the operator who has the portable storage medium 46.

Figure 16:
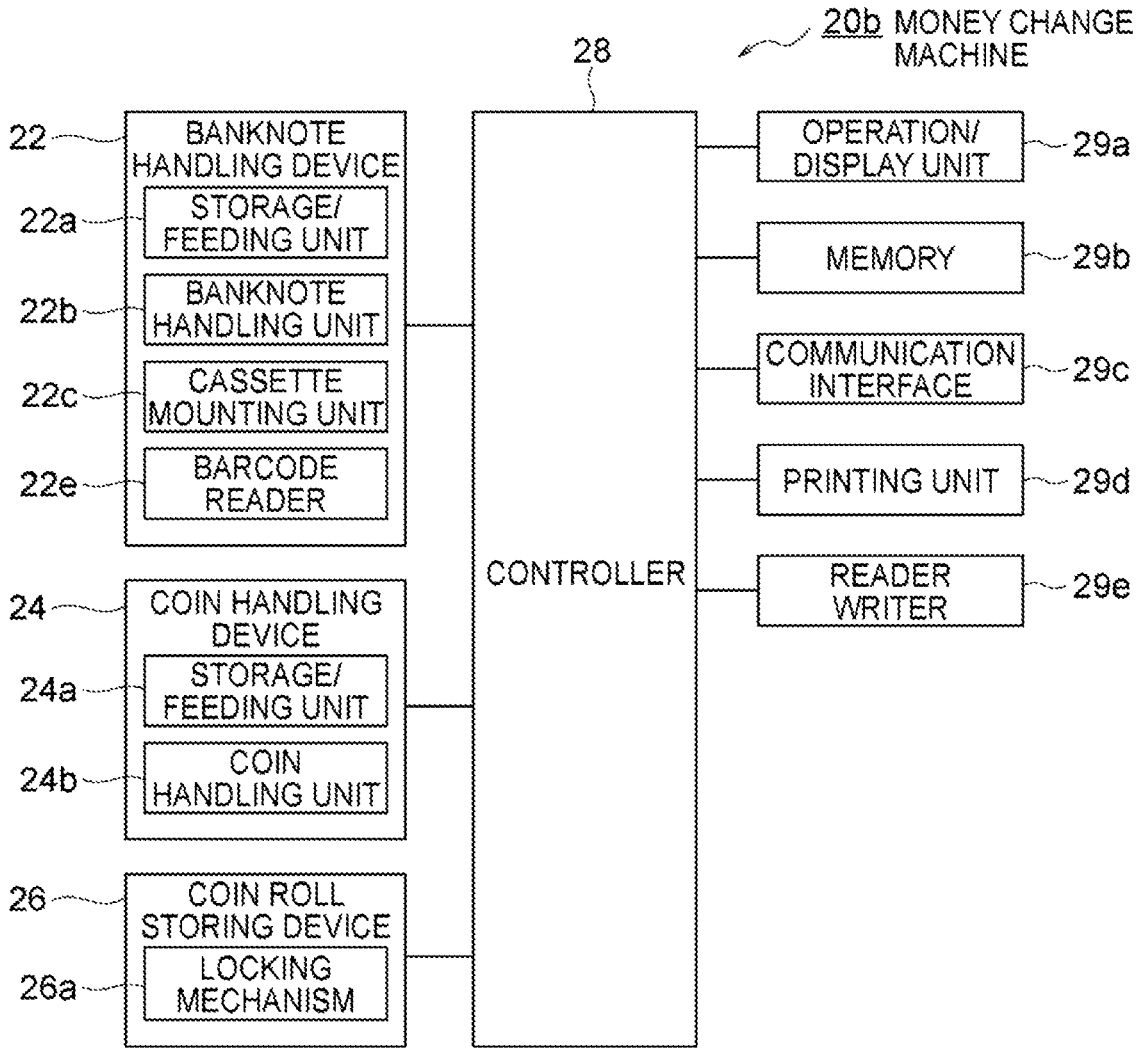
FIG. 16 is a functional block diagram illustrating a configuration of a control system of a money change machine of the money handling system shown in FIG. 15.

As shown in FIG. 16, the banknote handling device 22 of the money change machine 20*b* has the barcode reader 22*e* for reading identification information of the storage cassette 40 from the recognition medium 44 of the storage cassette 40 mounted to the cassette mounting unit 22*c*. By the barcode reader 22*e* having such a configuration being disposed, when the storage cassette 40 is mounted to the cassette mounting unit 22*c* in the banknote handling device 22 of the money change machine 20*b*, the identification information such as the identification number of the storage cassette 40 is read from the recognition medium 44 by the barcode reader 22*e* and transmitted to the controller 28. The money change machine 20*b* has a reader writer 29*e* for reading information from the portable storage medium 46 such as an IC card of the operator, and writing information in the portable storage medium 46. The reader writer 29*e* having such a configuration is connected to the controller 28.

Figure 17:
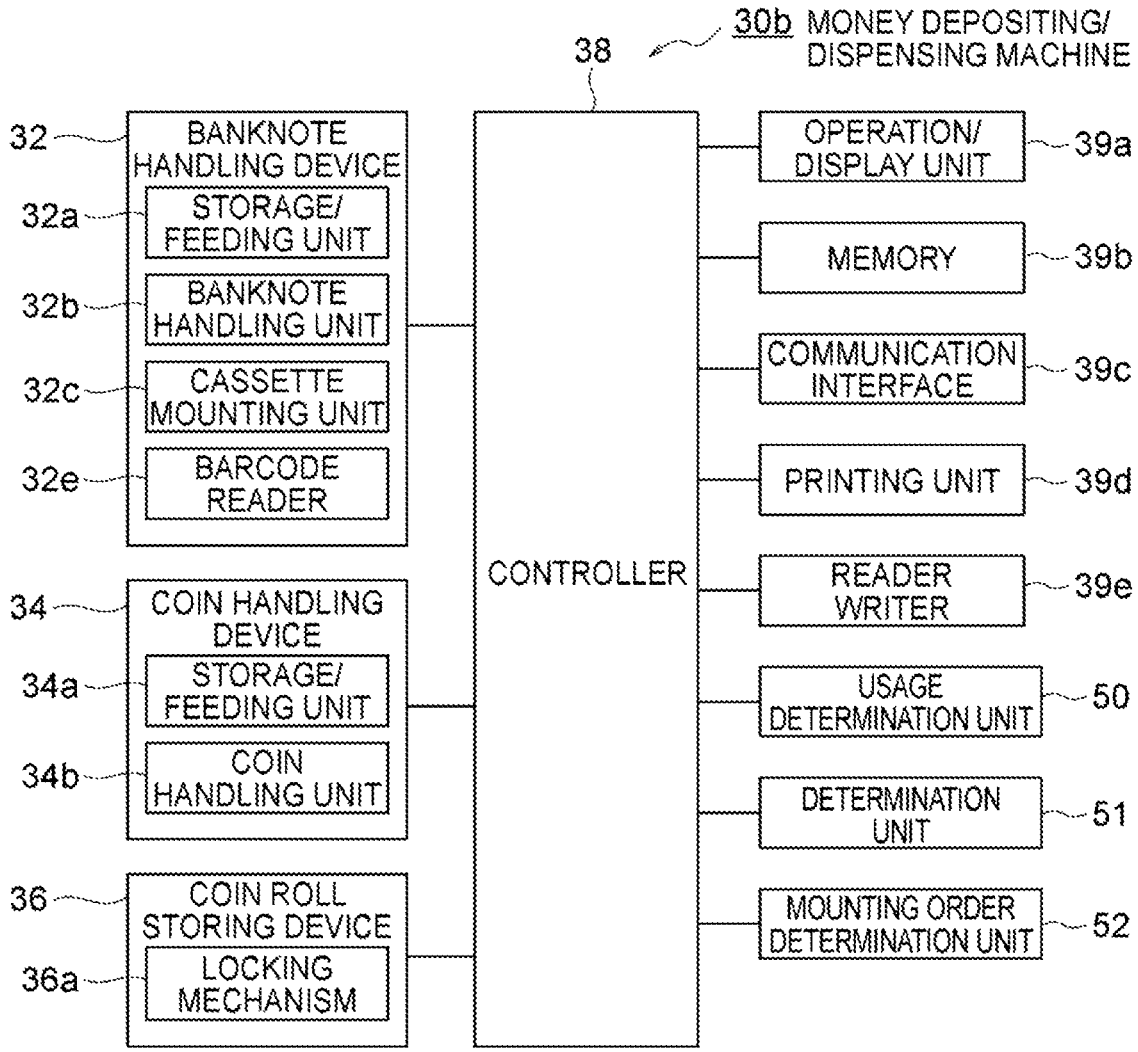
FIG. 17 is a functional block diagram illustrating a configuration of a control system of a money depositing/dispensing machine of the money handling system shown in FIG. 15.

As shown in FIG. 17, the banknote handling device 32 of the money depositing/dispensing machine 30*b* also has the barcode reader 32*e* for reading the identification information of the storage cassette 40 from the recognition medium 44 of the storage cassette 40 mounted to the cassette mounting unit 32*c*. By the barcode reader 32*e* having such a configuration being disposed, when the storage cassette 40 is mounted to the cassette mounting unit 32*c* in the banknote handling device 32 of the money depositing/dispensing machine 30*b*, the identification information such as the identification number of the storage cassette 40 is read from the recognition medium 44 by the barcode reader 32*e* and transmitted to the controller 38. The money depositing/dispensing machine 30*b* has a reader writer 39*e* for reading information from the portable storage medium 46 such as an IC card of the operator, and writing information in the portable storage medium 46. The reader writer 39*e* having such a configuration is connected to the controller 38.

Figure 15:
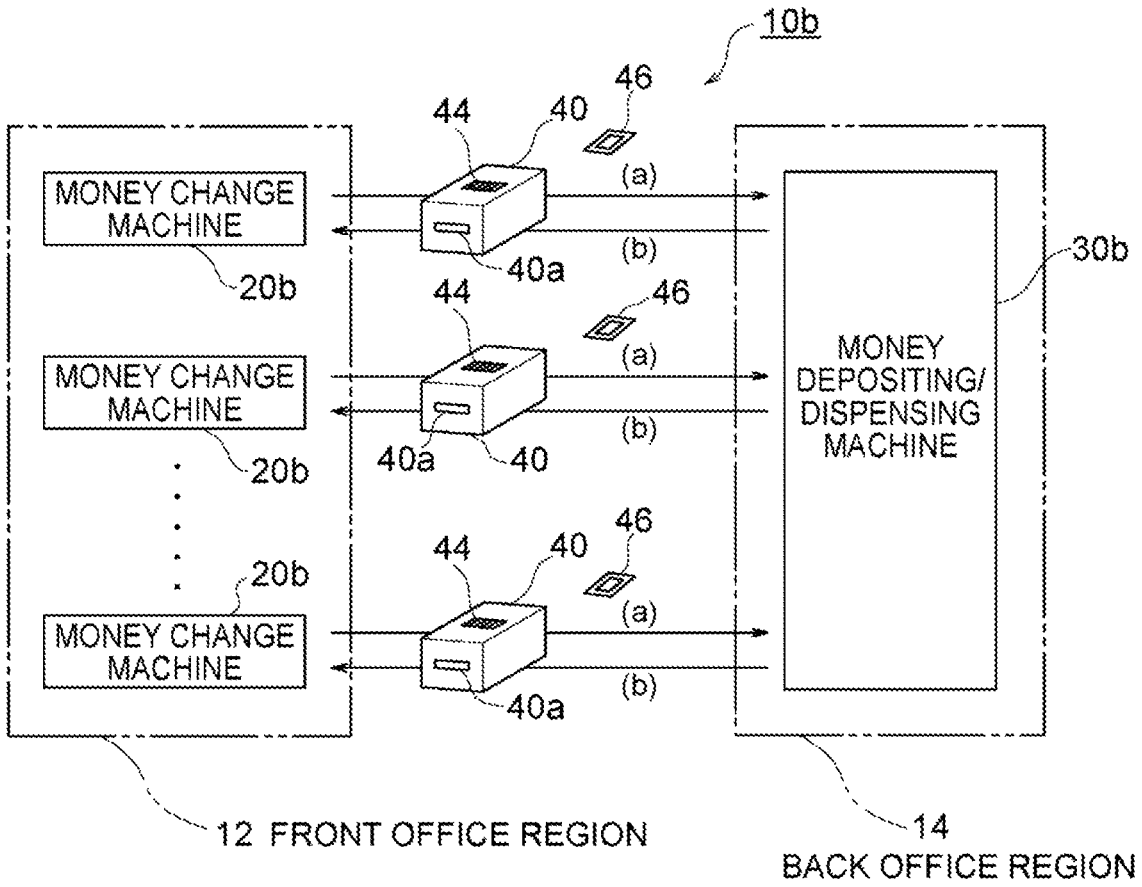
FIG. 15 is a schematic diagram illustrating a schematic configuration of still another example of a money handling system according to an embodiment of the present invention.

Next, an operation (that is, operation indicated by reference numeral (a) in FIG. 15) performed by the money handling system 10*b* having such a configuration in the collection process will be described. When the business hours of the store end, the clerk in charge of the register who has performed commodity settlement at the settlement place collects money and mediums (for example, vouchers and the like) other than the money from the money change machine 20*b*. Specifically, the clerk in charge of the register firstly causes the reader writer 29*e* of the money change machine 20*b* to read the portable storage medium 46 which stores the identification information such as the identification number of the clerk in charge of the register. Thus, the controller 28 obtains the identification information of the operator and performs authentication of the authority of the operator. When the authority of the operator which has been read from the portable storage medium 46 by the reader writer 29*e* is authenticated as the authority of the operator who is authorized to collect banknotes from the banknote handling device 22 of the money change machine 20*b*, the clerk in charge of the register mounts the empty storage cassette 40 to the cassette mounting unit 22*c* of the banknote handling device 22 to store banknotes, as proceeds from sales, which are stored in the storage/feeding unit 22*a* of the banknote handling device 22, in the storage cassette 40. After banknotes as proceeds from sales and the like have been collected from the banknote handling device 22 and the like, when the operator causes the reader writer 29*e* to read the portable storage medium 46 again, information (specifically, the number of banknotes for each denomination) and the like on, for example, banknotes collected from the banknote handling device 22 or the like is written into the portable storage medium 46 by the reader writer 29*e*.

The clerk in charge of the register who has collected money and mediums other than the money from the money change machine 20*b* in the front office region 12 collectively conveys the storage cassette 40 and the like from the front office region 12 to the back office region 14. Thereafter, the clerk in charge of the register causes the reader writer 39*e* of the money depositing/dispensing machine 30*b* to read information stored in the portable storage medium 46 of the clerk. Thus, the controller 38 obtains the identification information of the operator and performs authentication of the authority of the operator. When the authority of the operator which has been read from the portable storage medium 46 by the reader writer 39*e* is authenticated as the authority of the operator who is authorized to deposit banknotes from the storage cassette 40 in the banknote handling device 32 of the money depositing/dispensing machine 30*b*, the clerk in charge of the register mounts the storage cassette 40 to the cassette mounting unit 32*c* in the banknote handling device 32 of the money depositing/dispensing machine 30*b*. Thus, banknotes as proceeds from sales which are stored in the storage cassette 40 are fed out from the storage cassette 40, sent into the housing of the banknote handling device 32, and stored in the storage/feeding unit 32*a* of the banknote handling device 32.

Also in the money handling system 10*b* shown in FIG. 15 to FIG. 18, similarly to the money handling system 10 shown in FIG. 1 to FIG. 10, in a case where a large number of banknotes are to be collected from the money change machine 20*b* in one transaction (in other words, collection process performed at one time), a plurality of the storage cassettes 40 may be used. In this case, the plurality of the storage cassettes 40 to which banknotes have been sent from the banknote handling device 22 (specifically, the storage/feeding unit 22*a*) in the money change machine 20*b* are conveyed to the money depositing/dispensing machine 30*b*, and banknotes are thereafter stored into the banknote handling device 32 (specifically, the storage/feeding unit 32*a*) of the money depositing/dispensing machine 30*b*, from the storage cassettes 40 one by one, in the money depositing/dispensing machine 30*b*.

Figures 18, 19:
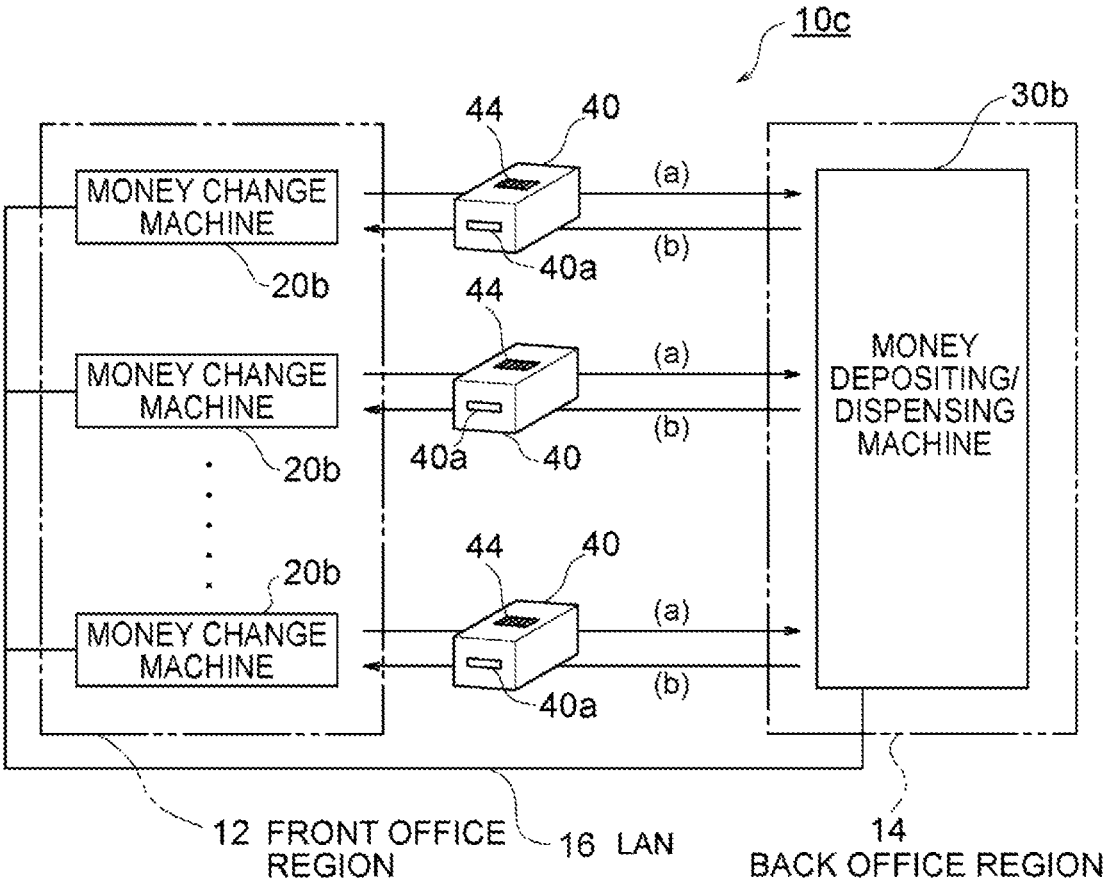
FIG. 18 shows a table representing information, of storage cassettes used in the banknote collection process, which is stored in a portable storage medium held by an operator such as a clerk in charge of a register in the money handling system shown in FIG. 15.
FIG. 19 is a schematic diagram illustrating a schematic configuration of still another example of a money handling system according to an embodiment of the present invention.

More specifically, in the money handling system 10*b*, in a case where the collection process is performed using the plurality of the storage cassettes 40, after banknotes as proceeds from sales are sent to the plurality of the storage cassettes 40 from the storage/feeding unit 22*a* of the banknote handling device 22, when the operator causes the reader writer 29*e* to read the portable storage medium 46 again, the identification information such as the identification number of each storage cassette 40 to which banknotes have been sent from the storage/feeding unit 22*a* of the banknote handling device 22 and the order in which the storage cassette 40 has been mounted to the cassette mounting unit 22*c* are written into the portable storage medium 46 by the reader writer 29*e* (see FIG. 18). That is, in the example shown in FIG. 18, information indicating that the storage cassettes 40 having the identification numbers of 008, 002, 001, 003, and 005 have been mounted to the cassette mounting unit 22*c* of the banknote handling device 22 in this order, and banknotes have been sent to these storage cassettes 40 from the storage/feeding unit 22*a* of the banknote handling device 22, is written into the portable storage medium 46 by the reader writer 29*e*. At this time, information on the banknotes stored in each storage cassette 40 is also written into the portable storage medium 46 by the reader writer 29*e* so as to be associated with the identification number of the storage cassette 40.

The clerk in charge of the register conveys the plurality of the storage cassettes 40 from the front office region 12 to the back office region 14, and the storage cassettes 40 are mounted one by one to the cassette mounting unit 32*c* in the banknote handling device 32 of the money depositing/dispensing machine 30*b*. In the present embodiment, before the storage cassette 40 is mounted to the cassette mounting unit 32*c*, information stored in the portable storage medium 46 of the clerk in charge of the register is read by the reader writer 39*e* of the money depositing/dispensing machine 30*b*. Thus, the controller 38 can obtain the identification information such as the identification number of each storage cassette 40 to which banknotes have been sent from the storage/feeding unit 22*a* of the banknote handling device 22 and the order in which the storage cassette 40 has been mounted to the cassette mounting unit 22*c*, as shown in FIG. 18. Thus, information on the number of the storage cassettes 40 to which banknotes have been sent from the storage/feeding unit 22*a* of the banknote handling device 22 is also obtained by the controller 38.

Thereafter, the clerk in charge of the register sequentially mounts the plurality of the storage cassettes 40 to the cassette mounting unit 32*c* of the banknote handling device 32 of the money depositing/dispensing machine 30*b*, whereby banknotes as proceeds from sales are sent from each storage cassette 40 to the storage/feeding unit 32*a*. In a case where the identification number of the storage cassette 40 which has been read by the barcode reader 32*e* from the recognition medium 44 of the storage cassette 40 mounted to the cassette mounting unit 32*c* is not identical to the identification number, of the storage cassette 40 to which banknotes have been sent from the storage/feeding unit 22*a* of the banknote handling device 22, which has been read from the portable storage medium 46 by the reader writer 39*e*, the controller 38 determines that an incorrect storage cassette 40 is mounted to the cassette mounting unit 32*c*. In this case, a message indicating that an incorrect storage cassette 40 has been mounted to the cassette mounting unit 32*c* is displayed on the operation/display unit 39*a*. Meanwhile, in a case where the identification number of the storage cassette 40 which has been read by the barcode reader 32*e* from the recognition medium 44 of the storage cassette 40 mounted to the cassette mounting unit 32*c* is identical to the identification number, of the storage cassette 40 to which banknotes have been sent from the storage/feeding unit 22*a* of the banknote handling device 22, which has been read from the portable storage medium 46 by the reader writer 39*e*, banknotes are fed out from the storage cassette 40 mounted to the cassette mounting unit 32*c*, and the banknotes having been fed out are sent to the storage/feeding unit 32*a*.

In a case where the number of the storage cassettes 40 mounted to the cassette mounting unit 32*c* does not reach the number, of the storage cassettes 40 to which banknotes have been sent from the storage/feeding unit 22*a* of the banknote handling device 22, which has been read from the portable storage medium 46 by the reader writer 39*e*, the controller 38 determines that the storage cassette 40 which has not been mounted to the cassette mounting unit 32*c* remains. In this case, the screen as shown in FIG. 10 is displayed on the operation/display unit 39*a*. Specifically, information indicating that the storage cassette 40 which has not been mounted to the cassette mounting unit 32*c* in the banknote handling device 32 of the money depositing/dispensing machine 30*b* is present is displayed on the operation/display unit 39*a*, and a message for prompting the operator to mount, to the cassette mounting unit 32*c*, the storage cassette 40 which has not been mounted is displayed on the operation/display unit 39*a*. Thus, the operator knows that, among the plurality of the storage cassettes 40 to which banknotes have been sent from the storage/feeding unit 22*a* in the banknote handling device 22 of the money change machine 20*b*, the storage cassette 40 which has not been mounted to the cassette mounting unit 32*c* of the banknote handling device 32 is present. When all the plurality of the storage cassettes 40 to which banknotes have been sent from the storage/feeding unit 22*a* in the banknote handling device 22 of the money change machine 20*b* have been mounted to the cassette mounting unit 32*c* in the banknote handling device 32 of the money depositing/dispensing machine 30*b*, and all the banknotes have been sent from each storage cassette 40 to the storage/feeding unit 32*a* of the banknote handling device 32, the collection process using the plurality of the storage cassettes 40 ends.

Thus, when the plurality of the storage cassettes 40 are used in one collection process, the determination unit 51 determines whether or not banknotes have been sent, from all the storage cassettes 40 to which banknotes have been sent from the banknote handling device 22 (specifically, the storage/feeding unit 22*a*) in the money change machine 20*b*, into the banknote handling device 32 (specifically, the storage/feeding unit 32*a*) in the money depositing/dispensing machine 30*b*. As shown in FIG. 15, in a case where a plurality of the money change machines 20*b* are disposed, the determination unit 51 determines, for each money change machine 20*b*, whether or not banknotes have been sent, from all the storage cassettes 40 to which banknotes have been sent from the banknote handling device 22 in the money change machine 20*b*, into the banknote handling device 32 in the money depositing/dispensing machine 30*b*.

In still another example of the money handling system of the present embodiment, as shown in FIG. 19, a money handling system 10*c* in which each money change machine 20*b* and the money depositing/dispensing machine 30*b* are connected so as to be communicable with each other via the LAN 16 or the like in a wired or wireless manner. The money handling system 10*c* shown in FIG. 19 is different from the money handling system 10*b* shown in FIG. 15 to FIG. 18 only in that the portable storage medium 46 such as an IC card is not used but each money change machine 20*b* and the money depositing/dispensing machine 30*b* are connected so as to be communicable with each other via the LAN 16 or the like in a wired or wireless manner in the money handling system 10*c*. The other components are almost the same therebetween. In the description of the money handling system 10*c* shown in FIG. 19, the same components as in the money handling system 10*b* shown in FIG. 15 to FIG. 18 are denoted by the same reference numerals, and the description thereof is omitted.

An operation (that is, operation indicated by reference numeral (a) in FIG. 19) performed by the money handling system 10*c* shown in FIG. 19 in the collection process will be described. When the business hours of the store end, the clerk in charge of the register who has performed commodity settlement at the settlement place collects money and mediums (for example, vouchers and the like) other than the money from the money change machine 20*b*. Specifically, the clerk in charge of the register mounts the empty storage cassette 40 to the cassette mounting unit 22*c* of the banknote handling device 22, to store banknotes, as proceeds from sales, which are stored in the storage/feeding unit 22*a* of the banknote handling device 22, in the storage cassette 40. The identification information such as the identification number of the storage cassette 40 is read by the barcode reader 22*e* from the recognition medium 44 of the storage cassette 40 mounted to the cassette mounting unit 22*c*, and the identification information of the storage cassette 40 is transmitted via the LAN 16 from the controller 28 of the money change machine 20*b* to the controller 38 of the money depositing/dispensing machine 30*b*. Information (specifically, the number of banknotes for each denomination) on banknotes which have been sent to the storage cassette 40 from the storage/feeding unit 22*a* of the banknote handling device 22 is also transmitted via the LAN 16 from the controller 28 of the money change machine 20*b* to the controller 38 of the money depositing/dispensing machine 30*b*.

In the front office region 12, the clerk in charge of the register who has collected the money and the mediums other than the money from the money change machine 20*b* collectively conveys the storage cassette 40 and the like from the front office region 12 to the back office region 14. Thereafter, the clerk in charge of the register mounts the storage cassette 40 to the cassette mounting unit 32*c* in the banknote handling device 32 of the money depositing/dispensing machine 30*b*. Thus, banknotes, as proceeds from sales, which are stored in the storage cassette 40 are fed out from the storage cassette 40 and sent into the housing of the banknote handling device 32, and stored in the storage/feeding unit 32*a* of the banknote handling device 32.

Also in the money handling system 10*c* shown in FIG. 19, similarly to the money handling system 10 shown in FIG. 1 to FIG. 10 and the money handling system 10*b* shown in FIG. 15 to FIG. 18, in a case where a large number of banknotes are to be collected from the money change machine 20*b* in one transaction (in other words, collection process performed at one time), a plurality of the storage cassettes 40 may be used. In this case, the plurality of the storage cassettes 40 to which banknotes have been sent from the banknote handling device 22 (specifically, the storage/feeding unit 22*a*) in the money change machine 20*b* are conveyed to the money depositing/dispensing machine 30*b*, and banknotes are thereafter stored into the banknote handling device 32 (specifically, the storage/feeding unit 32*a*) of the money depositing/dispensing machine 30*b*, from the storage cassettes 40 one by one, in the money depositing/dispensing machine 30*b*.

More specifically, in the money handling system 10*c*, in a case where the collection process is performed using the plurality of the storage cassettes 40, after banknotes as proceeds from sales have been sent to the plurality of the storage cassettes 40 from the storage/feeding unit 22*a* of the banknote handling device 22, the identification information such as the identification numbers of the plurality of the storage cassettes 40 to which banknotes have been sent from the storage/feeding unit 22*a* of the banknote handling device 22, and information on the order in which the storage cassettes 40 have been mounted to the cassette mounting unit 22*c* are transmitted via the LAN 16 from the controller 28 of the money change machine 20*b* to the controller 38 of the money depositing/dispensing machine 30*b*. Information on banknotes stored in each storage cassette 40 is associated with the identification number of the storage cassette 40 and transmitted via the LAN 16 from the controller 28 of the money change machine 20*b* to the controller 38 of the money depositing/dispensing machine 30*b*. Thus, information on the number of the storage cassettes 40 to which banknotes have been sent from the storage/feeding unit 22*a* of the banknote handling device 22 is also obtained by the controller 38.

The clerk in charge of the register conveys the plurality of the storage cassettes 40 from the front office region 12 to the back office region 14, and mounts the storage cassettes 40 one by one to the cassette mounting unit 32*c* in the banknote handling device 32 of the money depositing/dispensing machine 30*b*. Thus, banknotes as proceeds from sales are sent from each storage cassette 40 to the storage/feeding unit 32*a*. In a case where the identification number of the storage cassette 40 which has been read by the barcode reader 32*e* from the recognition medium 44 of the storage cassette 40 mounted to the cassette mounting unit 32*c* is not identical to the identification number, of the storage cassette 40 to which banknotes have been sent from the storage/feeding unit 22*a* of the banknote handling device 22, which has been transmitted via the LAN 16 from the controller 28 of the money change machine 20*b* to the controller 38 of the money depositing/dispensing machine 30*b*, the controller 38 determines that an incorrect storage cassette 40 is mounted to the cassette mounting unit 32*c*. In this case, a message indicating that an incorrect storage cassette 40 has been mounted to the cassette mounting unit 32*c* is displayed on the operation/display unit 39*a*. Meanwhile, in a case where the identification number of the storage cassette 40 which has been read by the barcode reader 32*e* from the recognition medium 44 of the storage cassette 40 mounted to the cassette mounting unit 32*c* is identical to the identification number, of the storage cassette 40 to which banknotes have been sent from the storage/feeding unit 22*a* of the banknote handling device 22, which has been transmitted via the LAN 16 from the controller 28 of the money change machine 20*b* to the controller 38 of the money depositing/dispensing machine 30*b*, banknotes are fed out from the storage cassette 40 mounted to the cassette mounting unit 32*c*, and the banknotes having been fed out are sent to the storage/feeding unit 32*a*.

In a case where the number of the storage cassettes 40 mounted to the cassette mounting unit 32*c* does not reach the number, of the storage cassettes 40 to which banknotes have been sent from the storage/feeding unit 22*a* of the banknote handling device 22, which has been transmitted via the LAN 16 from the controller 28 of the money change machine 20*b* to the controller 38 of the money depositing/dispensing machine 30*b*, the controller 38 determines that the storage cassette 40 which has not been mounted to the cassette mounting unit 32*c* remains. In this case, the screen as shown in FIG. 10 is displayed on the operation/display unit 39*a*. Specifically, information indicating that the storage cassette 40 which has not been mounted to the cassette mounting unit 32*c* in the banknote handling device 32 of the money depositing/dispensing machine 30*b* is present is displayed on the operation/display unit 39*a*, and a message for prompting the operator to mount, to the cassette mounting unit 32*c*, the storage cassette 40 which has not been mounted is displayed on the operation/display unit 39*a*. Thus, the operator is allowed to know that, among the plurality of the storage cassettes 40 to which banknotes have been sent from the storage/feeding unit 22*a* in the banknote handling device 22 of the money change machine 20*b*, the storage cassette 40 which has not been mounted to the cassette mounting unit 32*c* of the banknote handling device 32 is present. When all the plurality of the storage cassettes 40 to which banknotes have been sent from the storage/feeding unit 22*a* in the banknote handling device 22 of the money change machine 20*b* have been mounted to the cassette mounting unit 32*c* in the banknote handling device 32 of the money depositing/dispensing machine 30*b*, and all the banknotes have been sent from each storage cassette 40 to the storage/feeding unit 32*a* of the banknote handling device 32, the collection process using the plurality of the storage cassettes 40 ends.

Thus, in the banknote collection process, when the plurality of the storage cassettes 40 are used, the determination unit 51 determines whether or not banknotes have been sent, from all the storage cassettes 40 to which banknotes have been sent from the banknote handling device 22 (specifically, the storage/feeding unit 22*a*) in the money change machine 20*b*, into the banknote handling device 32 (specifically, the storage/feeding unit 32*a*) in the money depositing/dispensing machine 30*b*. When a plurality of the money change machines 20*b* are disposed as shown in FIG. 15 and FIG. 19, the determination unit 51 determines, for each money change machine 20*b*, whether or not banknotes have been sent, from all the storage cassettes 40 to which banknotes have been sent from the banknote handling device 22 in the money change machine 20*b*, into the banknote handling device 32 in the money depositing/dispensing machine 30*b*.

In the money handling system 10*b* shown in FIG. 15 to FIG. 18 and the money handling system 10*c* shown in FIG. 19, in a case where the collection process is performed using the plurality of the storage cassettes 40, while the storage cassettes 40 are being mounted one by one to the cassette mounting unit 32*c* in the banknote handling device 32 of the money depositing/dispensing machine 30*b*, depositing of banknotes in the banknote handling device 32 can be stopped. Specifically, as shown in FIG. 10, in a case where the operator such as the clerk in charge of the register presses the "forced termination" button displayed on the operation/display unit 39*a* in a state where the storage cassette 40 which has not been mounted to the cassette mounting unit 32*c* in the banknote handling device 32 of the money depositing/dispensing machine 30*b* remains, depositing of banknotes from the storage cassettes 40 in the banknote handling device 32 is stopped. In this case, the controller 38 outputs information on the storage cassettes 40 to which banknotes have been sent from the banknote handling device 22 (specifically, the storage/feeding unit 22*a*) of the money change machine 20*b* and which has not sent the banknotes into the banknote handling device 32 (specifically, the storage/feeding unit 32*a*) of the money depositing/dispensing machine 30*b*, and the outputted information is displayed on the operation/display unit 39*a*. Specifically, the information on, for example, the number of the storage cassettes 40 which have not been mounted to the cassette mounting unit 32*c* in the banknote handling device 32 of the money depositing/dispensing machine 30*b* at a point in time when the collection process has been stopped and identification information (specifically, the identification numbers) of the storage cassettes 40 are displayed on the operation/display unit 39*a*. Information on banknotes stored in the storage cassettes 40 which have not been mounted to the cassette mounting unit 32*c* in the banknote handling device 32 of the money depositing/dispensing machine 30*b* may also be displayed on the operation/display unit 39*a*. Thus, when the collection process is stopped, the operator is allowed to recognize the number of the storage cassettes 40 which have not been mounted to the cassette mounting unit 32*c* in the banknote handling device 32 of the money depositing/dispensing machine 30*b* and the identification information of the storage cassettes 40.

As the money handling system 10*c* shown in FIG. 19, an exemplary money handling system in which each money change machine 20*b* and the money depositing/dispensing machine 30*b* are connected so as to be communicable with each other via the LAN 16, and each storage cassette 40 has the recognition medium 44 such as a barcode, has been described. The present embodiment is not limited to such an example. In still another example of the present embodiment, the money handling system 10 shown in FIG. 1 to FIG. 10 may be configured such that each money change machine 20 and the money depositing/dispensing machine 30 are connected so as to be communicable with each other via the LAN, and, when a plurality of the storage cassettes 40 are used in the collection process, information on the number of storage cassettes to which banknotes have been sent from the money change machine 20 is transmitted from the controller 28 of the money change machine 20 to the controller 38 of the money depositing/dispensing machine 30. In this case, the determination unit 51 determines whether or not banknotes have been sent into the money depositing/dispensing machine 30 from all the storage cassettes 40 to which banknotes have been sent from the money change machine 20, based on the number, of the storage cassettes 40 to which banknotes have been sent from the money change machine 20 in the collection process, which has been transmitted from the controller 28 of the money change machine 20 to the controller 38 of the money depositing/dispensing machine 30, and the number of the storage cassettes 40 mounted to the money depositing/dispensing machine 30.

In the money handling systems 10, 10*a* according to the present embodiment having the above-described configurations, and the money depositing/dispensing machines 30, 30*a* disposed in the money handling systems 10, 10*a*, banknotes are sent from the storage/feeding unit 32*a* to the empty storage cassette 40 mounted to the cassette mounting unit 32*c*, according to a storing state of banknotes in the storage/feeding unit 32*a*. In a case where banknotes are thus sent from the storage/feeding unit 32*a* to the empty storage cassette 40 according to a storing state of banknotes in the storage/feeding unit 32*a*, even when banknotes in the storage/feeding unit 32*a* become insufficient while change fund is prepared, replenishment of banknotes can be performed merely by mounting the storage cassette 40, whereby, for example, an operation of taking out banknotes from a collection cassette (not shown) can be eliminated, and this reduces an operator's workload and a replenishing time.

More specifically, in a conventional money handling system, a storage cassette which is detachably mounted to a banknote handling device of a money depositing/dispensing machine may have been used for collection and replenishment but has not been used for storage. Therefore, in the conventional money handling system, in a case where the entire collection process in which all the money are collected from a plurality of money change machines and deposited in the money depositing/dispensing machine is periodically performed, when the storage/feeding unit disposed in the money depositing/dispensing machine has been in a full state and money can no longer be stored in the storage/feeding unit during the entire collection process, the process of depositing money collected from the money change machine in the money depositing/dispensing machine is stopped and money needs to be collected from the storage/feeding unit in the full state. However, in a case where the replenishing process of replenishing a plurality of money change machines with change fund is performed after the entire collection process, when change fund that exceeds the capacity of the storage/feeding unit is necessary, the money collected in the collection cassette is taken out with hands and the replenishing process in the money depositing/dispensing machine needs to be performed, and an operator's workload and the time for the replenishing process tend to be increased. Meanwhile, in the present embodiment, by banknotes being sent from the storage/feeding unit 32*a* to the empty storage cassette 40 mounted to the cassette mounting unit 32*c* according to a storing state of banknotes in the storage/feeding unit 32*a*, banknotes stored in the storage/feeding unit 32*a* can be temporarily stored in the storage cassette 40. Therefore, in a case where the replenishing process of replenishing a plurality of the money change machines 20, 20*a* with change fund is performed after the entire collection process, when change fund which exceeds the capacity of the storage/feeding unit 32*a* is necessary, banknotes are returned from the storage cassette 40 to the storage/feeding unit 32*a* merely by mounting, to the money depositing/dispensing machine 30, 30*a*, the storage cassette 40 that temporarily stores banknotes, whereby the storage/feeding unit 32*a* can be replenished with banknotes. Thus, in the present embodiment, for example, an operation of taking out banknotes from the collection cassette (not shown) can be eliminated, and this reduces an operator's workload and a replenishing time.

In the money handling systems 10, 10*a* according to the present embodiment and the money depositing/dispensing machines 30, 30*a* disposed in the money handling systems 10, 10*a*, as described above, the usage determination unit 50 is disposed for determining the usage of the storage cassette 40 mounted to the cassette mounting unit 32*c*, according to a storing state of banknotes in the storage/feeding unit 32*a*. Thus, the usage of the storage cassette 40 mounted to the cassette mounting unit 32*c* is determined according to a storing state of banknotes in the storage/feeding unit 32*a*, whereby the usage of the storage cassette 40 can be made appropriate.

In the money handling systems 10, 10*a* according to the present embodiment and the money depositing/dispensing machines 30, 30*a* disposed in the money handling systems 10, 10*a*, as described above, the usage determination unit 50 determines, as storage, the usage of the storage cassette 40 mounted to the cassette mounting unit 32*c* when banknotes can no longer be stored in the storage/feeding unit 32*a*. The usage determination unit 50 can determine, as storage, the usage of the storage cassette 40 mounted to the cassette mounting unit 32*c* only in a case where no banknotes are stored in the storage cassette 40 when the storage cassette 40 is mounted to the cassette mounting unit 32*c*. In other words, in a case where the storage cassette 40 is mounted to the cassette mounting unit 32*c*, when banknotes are stored in the storage cassette 40, the banknotes are considered to have been collected from the banknote handling device 22 of the money change machine 20. Therefore, the usage determination unit 50 determines, as collection, the usage of the storage cassette 40 mounted to the cassette mounting unit 32*c*, and banknotes are fed out from the storage cassette 40 and stored in the storage/feeding unit 32*a*.

In the money handling system 10 shown in FIG. 1 to FIG. 10, the storage cassette 40 has the storage medium 42, and the banknote handling device 32 of the money depositing/dispensing machine 30 has the reader writer 32*d* as a wiring unit for writing information in the storage medium 42 disposed in the storage cassette 40 which is mounted to the cassette mounting unit 32*c*. Information on the usage of the storage cassette 40 which is determined by the usage determination unit 50 is written into the storage medium 42 disposed in the storage cassette 40, by the reader writer 32*d* as the writing unit. In this case, the reader writer 32*d* also functions as a reading unit for reading information from the storage medium 42 disposed in the storage cassette 40 which is mounted to the cassette mounting unit 32*c*.

In the money handling system 10*a* shown in FIG. 11 to FIG. 14, the storage cassette 40 has the recognition medium 44 representing identification information of the storage cassette 40, and the banknote handling device 32 of the money depositing/dispensing machine 30 has the barcode reader 32*e* as an identification information reading unit for reading the identification information of the storage cassette 40 from the recognition medium 44 disposed in the storage cassette 40 which is mounted to the cassette mounting unit 32*c*. The money depositing/dispensing machine 30 has the memory 39*b*, and information on the usage of the storage cassette 40 which is determined by the usage determination unit 50 is associated with the identification information of the storage cassette 40 which is read by the barcode reader 32*e* as the identification information reading unit, and stored in the memory 39*b* (see FIG. 14).

In the money handling system 10, 10*b*, 10*c* according to the present embodiment having the above-described configuration, the determination unit 51 is disposed for determining whether or not banknotes have been sent into the money depositing/dispensing machine 30, 30*b* from all the storage cassettes 40 to which banknotes have been sent from the money change machine 20, 20*b* when a plurality of the storage cassettes 40 are used in the collection process in which banknotes are collected from the money change machine 20, 20*b* and deposited in the money depositing/dispensing machine 30, 30*b*. Thus, whether or not banknotes have been sent into the money depositing/dispensing machine 30, 30*b* from all the storage cassette 40 to which banknotes have been sent from the money change machine 20, 20*b* is determined when a plurality of the storage cassettes 40 are used in one collection process, and this can inhibit the operator from forgetting to mount one or more of the plurality of the storage cassettes 40 to the money depositing/dispensing machine 30, 30*b*, thereby preventing an error in calculation from occurring in the money depositing/dispensing machine 30, 30*b*.

More specifically, in a conventional money handling system, when a plurality of storage cassettes are used in one collection process, the money depositing/dispensing machine cannot obtain the number of storage cassettes into which banknotes have been stored from the money change machine. Therefore, the operator may forget to mount one or more of the plurality of storage cassettes to the money depositing/dispensing machine. In this case, a problem may arise that an error in calculation occurs in the money depositing/dispensing machine. Meanwhile, in the present embodiment, whether or not money has been sent into the money depositing/dispensing machine 30, 30*b* from all the storage cassettes 40 to which money has been sent from the money change machine 20, 20*b* is determined when a plurality of the storage cassettes 40 are used in one collection process, so that the problem of the conventional money handling system can be overcome.

In the money handling system 10, 10*b*, 10*c* according to the present embodiment, as described above, information indicating whether or not banknotes have been sent into the money depositing/dispensing machine 30, 30*b* from all the storage cassettes 40 to which banknotes have been sent from the money change machine 20, 20*b* in the collection process is displayed on the operation/display unit 39*a* based on the determination result by the determination unit 51 (see FIG. 10). Thus, the operation/display unit 39*a* functions as a notification unit for making notification of information indicating whether or not banknotes have been sent into the money depositing/dispensing machine 30, 30*b* from all the storage cassettes 40 to which banknotes have been sent from the money change machine 20, 20*b* in the collection process, based on the determination result by the determination unit 51. Such a notification unit is not limited to the operation/display unit 39*a*, and may make the notification to the operator by another method such as sound.

In the money handling system 10, 10*b*, 10*c* according to the present embodiment, as described above, in a case where the number of the storage cassettes 40 to which banknotes have been sent from the money change machine 20, 20*b* and the number of the storage cassettes 40 which have sent banknotes into the money depositing/dispensing machine 30, 30*b* are not identical to each other, the determination unit 51 determines that money has not been sent into the money depositing/dispensing machine 30, 30*b* from all the storage cassettes 40 to which money has been sent from the money change machine 20, 20*b* in the collection process.

In the money handling system 10 shown in FIG. 1 to FIG. 10, in the storage medium 42 of the storage cassette 40 to which banknotes have been sent last from the money change machine 20 in the collection process, information indicating that the storage cassette 40 is the storage cassette 40 to which banknotes have been sent last and information on the number of the storage cassettes 40 to which banknotes have been sent from the money change machine 20 are written by the reader writer 22*d* (first writing unit). In the example shown in FIG. 8, as the number of the storage cassettes 40 to which banknotes have been sent from the money change machine 20, information on the number indicating the order in which the storage cassette 40 has been used in the collection process is written into the storage medium 42 by the reader writer 22*d*. However, the present embodiment is not limited to such an aspect. Instead of or in addition to the information on the number indicating the order in which the storage cassette 40 has been used in the collection process, the number of the storage cassettes 40 to which banknotes have been sent from the money change machine 20 may be written into the storage medium 42 by the reader writer 22*d*. The determination unit 51 determines whether or not banknotes have been sent into the money depositing/dispensing machine 30 from all the storage cassettes 40 to which banknotes have been sent from the money change machine 20, based on the number of the storage cassettes 40 mounted to the money depositing/dispensing machine 30 and the number, of the storage cassettes 40 to which banknotes have been sent from the money change machine 20 in the collection process, which is read from the storage medium 42 disposed in the storage cassette 40, by the reader writer 32*d* (first reading unit) of the money depositing/dispensing machine 30.

In the money handling system 10*b* shown in FIG. 15 to FIG. 18, information on the number of the storage cassettes 40 to which banknotes have been sent from the money change machine 20*b* in the collection process is written into the portable storage medium 46 by the reader writer 29*e* (second writing unit) of the money change machine 20*b*. The determination unit 51 determines whether or not banknotes have been sent into the money depositing/dispensing machine 30*b* from all the storage cassettes 40 to which banknotes have been sent from the money change machine 20*b*, based on the number of the storage cassettes 40 mounted to the money depositing/dispensing machine 30*b*, and the number, of the storage cassettes 40 to which banknotes have been sent from the money change machine 20*b* in the collection process, which has been read from the portable storage medium 46 by the reader writer 39*e* (second reading unit) of the money depositing/dispensing machine 30*b*.

In the money handling system 10*c* shown in FIG. 19, the money change machine 20*b* and the money depositing/dispensing machine 30*b* are connected so as to be communicable with each other, and information on the number of the storage cassettes 40 to which banknotes have been sent from the money change machine 20*b* in the collection process is transmitted from the money change machine 20*b* to the money depositing/dispensing machine 30*b*. The determination unit 51 determines whether or not banknotes have been sent into the money depositing/dispensing machine 30*b* from all the storage cassettes 40 to which banknotes have been sent from the money change machine 20*b*, based on the number of the storage cassettes 40 mounted to the money depositing/dispensing machine 30*b* and the number, of the storage cassettes 40 to which banknotes have been sent from the money change machine 20*b* in the collection process, which has been transmitted from the money change machine 20*b* to the money depositing/dispensing machine 30*b*.

In the money handling system 10, 10*b*, 10*c* according to the present embodiment, as described above, when the collection process is interrupted, the controller 38 outputs information on the storage cassette 40 to which banknotes have been sent from the money change machine 20, 20*b* and which has not sent banknotes into the money depositing/dispensing machine 30, 30*b*, and the outputted information is displayed on the operation/display unit 39*a*. Thus, the controller 38 functions as an unprocessed cassette information output unit for outputting information on the storage cassette 40 to which banknotes have been sent from the money change machine 20, 20*b* and which has not sent banknotes into the money depositing/dispensing machine 30, 30*b*, when the collection process is interrupted.

In the money depositing/dispensing machine 30, 30*b* of the money handling system 10, 10*b*, 10*c* according to the present embodiment, in the collection process in which money is collected from another device (specifically, the money change machine 20, 20*b*) and deposited in the money depositing/dispensing machine 30, 30*b*, when the storage cassette 40 is mounted to the cassette mounting unit 32*c*, banknotes are sent from the storage cassette 40 into the money depositing/dispensing machine 30, 30*b*. The money depositing/dispensing machine 30, 30*b* has the determination unit 51 for determining whether or not banknotes have been sent to the money depositing/dispensing machine 30, 30*b* from all the storage cassettes 40 to which banknotes have been sent from the other device when a plurality of the storage cassettes 40 are used in the collection process.

In the money change machine 20, 20*b* of the money handling system 10, 10*b*, 10*c* according to the present embodiment, in the collection process in which money is collected from the money change machine 20, 20*b* and deposited in another device (specifically, the money depositing/dispensing machine 30, 30*b*), banknotes are sent to the storage cassette 40 from the money change machine 20, 20*b* when the storage cassette 40 is mounted to the cassette mounting unit 22*c*. The controller 28 outputs information on the number of the storage cassettes 40 to which banknotes have been sent from the money change machine 20, 20*b* when a plurality of the storage cassettes 40 are used in the collection process. Thus, the controller 28 functions as a number-of-cassettes output unit for outputting information on the number of the storage cassettes 40 to which banknotes have been sent from the money change machine 20, 20*b* when a plurality of the storage cassettes 40 are used in the collection process.

The money handling system and the money depositing/dispensing machine according to the present invention are not limited to the above-described aspects, and various modifications can be made.

An operation performed by the money handling system 10, 10*a* shown in FIG. 1 to FIG. 14 in the entire collection process in which all the money is collected from a plurality of the money change machines 20, 20*a*, and deposited in the money depositing/dispensing machine 30, 30*a*, has been described above. However, a similar operation may be performed also in an inventory process in which all the money in the store are counted. More specifically, in the inventory process in which all the money in the store is counted, all the banknotes are sent to the storage cassette 40 from the banknote handling devices 22 of a plurality of the money change machines 20, 20*a*, and deposited from the storage cassette 40 to the banknote handling device 32 of the money depositing/dispensing machine 30, 30*a*. The banknotes are counted by the banknote handling device 32, and the banknotes are thereafter returned to the banknote handling devices 22 of the money change machines 20, 20*a* from the banknote handling device 32 by using the storage cassette 40. In such an operation, banknotes are sent from the storage/feeding unit 32*a* to the empty storage cassette 40 mounted to the cassette mounting unit 32*c* according to a storing state of banknotes in the storage/feeding unit 32*a*. Also in this case, in a case where banknotes in the storage/feeding unit 32*a* become insufficient while change fund is prepared, replenishment of banknotes can be performed merely by mounting the storage cassette 40, and, therefore, an operation of, for example, taking out banknotes from a collection cassette (not shown) can be eliminated, and this can reduce an operator's workload and a replenishing time.

In the above-described inventory process, the following operation may be performed. Specifically, in the inventory process, before money dispensed from each money change machine 20, 20*a* is deposited in the money depositing/dispensing machine 30, 30*a*, banknotes and coins stored in the storage/feeding unit 32*a* and the storage/feeding unit 34*a* are all sent to collection cassettes in the banknote handling device 32 and the coin handling device 34 of the money depositing/dispensing machine 30, 30*a*. Thereafter, in a case where money dispensed from each money change machine 20, 20*a* is deposited in the money depositing/dispensing machine 30, 30*a*, when the storage cassette 40 is mounted to the cassette mounting unit 32*c* in the banknote handling device 32 of the money depositing/dispensing machine 30, 30*a*, only ten thousand yen notes among the banknotes fed out from the storage cassette 40 are stored in the collection cassette of the banknote handling device 32, and banknotes of the other denominations are all stored in the storage/feeding unit 32*a* of the banknote handling device 32. Coins and coin rolls among money dispensed from each money change machine 20, 20*a* are all stored in the storage/feeding unit 34*a* of the coin handling device 34 and the coin roll storing device 36. After money is counted by the money depositing/dispensing machine 30, 30*a*, the banknotes and the coins stored in the storage/feeding unit 32*a* of the banknote handling device 32 and the storage/feeding unit 34*a* of the coin handling device 34 are dispensed. At this time, the banknotes dispensed from the banknote handling device 32 are stored in the storage cassette 40. The operator takes out the coin rolls stored in the coin roll storing device 36. Thereafter, the operator returns the banknotes, coins, and coin rolls dispensed from the banknote handling device 32, the coin handling device 34, and the coin roll storing device 36, into the initial money change machines 20, 20*a*. In such an operation, the ten thousand yen notes dispensed from the money change machines 20, 20*a* are stored in the collection cassette of the money depositing/dispensing machine 30, 30*a*, and, therefore, the ten thousand yen notes are not returned into the initial money change machines 20, 20*a*. However, the ten thousand yen notes are not required as change fund in general, and no problem arises if the ten thousand yen notes are not returned into the initial money change machines 20, 20*a*. When the inventory process is performed in such a manner, since the ten thousand yen notes dispensed from the money change machines 20, 20*a* are stored in the collection cassette of the money depositing/dispensing machine 30, 30*a*, a state where the storage/feeding unit 32*a* is in a full state or a nearly full state and banknotes can no longer be stored in the storage/feeding unit 32*a* can be avoided as much as possible. Thus, counting of banknotes and coins collected from the money change machines 20, 20*a* in the money depositing/dispensing machine 30, 30*a* is inhibited from becoming impossible during the counting, and, therefore, the inventory process can ben ended as early as possible.

In the money handling system 10, 10*a*, 10*b*, 10*c* shown in FIG. 1 to FIG. 19, the cassette mounting unit 32*c* to which the storage cassette 40 is mounted is disposed in the banknote handling device 32 of the money depositing/dispensing machine 30, 30*a*. However, the present invention is not limited to such an aspect. In a money handling system according to a modification, instead of the cassette mounting unit being disposed in the banknote handling device of the money depositing/dispensing machine, the storage cassette may be detachably mounted to an inlet or a receptacle of the banknote handling device. In this case, when the storage cassette is mounted to the inlet or the receptacle of the banknote handling device, banknotes fed out from the storage cassette can be sent into a housing of the banknote handling device through the inlet or the receptacle, and banknotes can be sent to the storage cassette from the housing of the banknote handling device through the inlet or the receptacle.

In the money handling system according to a modification, a plurality of spare storage cassettes (in other words, storage cassettes used for storage) may be disposed so as to correspond to respective banknote denominations. In this case, when the storage/feeding unit of the banknote handling device is in a full state or a nearly full state, the storage cassettes corresponding to the respective denominations are sequentially mounted to the cassette mounting unit, whereby banknotes can be stored in the plurality of storage cassettes based on the respective denominations. In a case where one storage cassette is used as a spare storage cassette, when the storage/feeding unit of the banknote handling device is in a full state or a nearly full state and the storage cassette is mounted to the cassette mounting unit, banknotes of a plurality of denominations are mixedly stored in the storage cassette.

In the money handling system according to another modification, a plurality of cassette mounting units may be disposed in the banknote handling device of the money depositing/dispensing machine. In this case, the storage cassette for collection and the storage cassette for storage can be simultaneously mounted to the banknote handling device. In this case, in a case where the above-described entire collection process is performed, even when the storage/feeding unit in the banknote handling device of the money depositing/dispensing machine is in a full state or a nearly full state, and banknotes can no longer be stored in the storage/feeding unit, banknotes can be sent from the storage/feeding unit to the storage cassette for storage without dismounting the storage cassette for collection from the banknote handling device.

In the money handling system according to still another modification, the storage cassette may be used to deliver coins between the coin handling device of each money change machine disposed in the front office region and the coin handling device of the money depositing/dispensing machine disposed in the back office region. In this case, the storage cassette for storing the coins and feeding out the stored coins is detachably mounted to each of the coin handling device of each money change machine and the coin handling device of the money depositing/dispensing machine. In the money depositing/dispensing machine, coins are sent from the storage/feeding unit into the empty storage cassette mounted to the coin handling device according to a storing state of coins in the coin handling device. In this case, even when coins in the storage/feeding unit become insufficient while change fund is prepared, replenishment of coins can be performed merely by mounting the storage cassette, whereby an operation of, for example, taking out coins from the collection cassette can be eliminated, and this can reduce an operator's workload and a replenishing time. In such a money handling system, a usage determination unit disposed in the money depositing/dispensing machine may determine the usage of the storage cassette mounted to the cassette mounting unit of the coin handling device according to a storing state of coins in the storage/feeding unit of the coin handling device. Specifically, the usage determination unit may determine, as storage, the usage of the storage cassette mounted to the cassette mounting unit when coins can no longer be stored in the storage/feeding unit of the coin handling device. The same operation as performed for the usage of the storage cassette for storing banknotes as described above is performed for the usage of the storage cassette for storing coins. In such a money handling system, a determination unit is disposed for determining whether or not coins have been sent into the coin handling device of the money depositing/dispensing machine from all the storage cassettes to which coins have been sent from the coin handling device of the money change machine when a plurality of storage cassettes are used in the collection process in which coins are collected from the coin handling device of the money change machine, and deposited in the coin handling device of the money depositing/dispensing machine. Thus, whether or not coins have been sent into the coin handling device of the money depositing/dispensing machine from all the storage cassettes to which coins have been sent from the coin handling device of the money change machine when a plurality of storage cassettes are used in the collection process, is determined, and this can inhibit the operator from forgetting to mount one or more of the plurality of storage cassettes to the coin handling device of the money depositing/dispensing machine, whereby an error in calculation can be prevented from occurring in the coin handling device of the money depositing/dispensing machine.

The invention claimed is:

1. A money handling system comprising:

a money change machine configured to deposit therein money received from outside as proceeds from sales and dispense therefrom the deposited money to outside as change; and a money handling machine configured to deposit therein money collected from the money change machine in a collection process by using a plurality of storage cassettes for storing therein money and feed out therefrom the stored money, wherein each storage cassette is capable of being detachably mounted to the money change machine and the money handling machine, and includes a storage medium that stores therein identification information for identifying each storage cassette, wherein the money change machine includes:

a writer configured to write, into each storage medium, number information on a number indicating an order of each of the storage cassettes to which money has been sent from the money change machine when the storage cassettes have been mounted to the money change machine in order, and a reader configured to read information including the identification information and the number information from the storage medium of each storage cassette being mounted to the money handling machine, wherein the money handling system further comprises:

a controller configured to determine whether or not money has been sent into the money handling machine from all of the storage cassettes which have been used in the collection process and have stored therein the money collected from the money change machine, based on the information read from the storage medium of each storage cassette by the reader of the money change machine, wherein the controller is configured to determine that an error occurs in the order in which the storage cassettes are mounted to the money handling machine when a first storage cassette which has been firstly mounted to the money handling machine in the collection process among the storage cassettes is not a last storage cassette which has been lastly mounted to the money handling machine in the collection process among the storage cassettes, based on the information read by the reader from the storage medium of the first storage cassette.

2. The money handling system according to claim 1, wherein the controller is configured to make notification of information indicating whether or not money has been sent into the money handling machine from all of the storage cassettes to which money has been sent from the money change machine in the collection process, based on a determination result by the controller.

3. The money handling system according to claim 1, wherein the controller is configured to determine that money has not been sent into the money handling machine from all of the storage cassettes to which money has been sent from the money change machine in the collection process, when a number of the storage cassettes to which money has been sent from the money change machine is not identical to a number of the storage cassettes which have sent money into the money handling machine.

4. The money handling system according to claim 1, wherein the writer is configured to write, in the storage medium of the last storage cassette to which money has been sent last from the money change machine in the collection process, information indicating that money has been sent to the last storage cassette and information on a number of the storage cassettes to which money has been sent from the money change machine.

5. The money handling system according to claim 1, wherein the writer is configured to write the information into a portable storage medium, the reader is configured to read the information from the portable storage medium, the information further includes information on a number of the storage cassettes to which money has been sent from the money change machine in the collection process is written into the portable storage medium by the writer of the money change machine, and the controller is configured to determine whether or not money has been sent into the money handling machine from all the storage cassettes to which money has been sent from the money change machine, based on the number of the storage cassettes mounted to the money handling machine, and the number, of the storage cassettes to which money has been sent from the money change machine in the collection process, which is read from the portable storage medium by the reader of the money change machine.

6. The money handling system according to claim 5, wherein the identification information of each storage cassette to which money has been sent from the money change machine in the collection process is also written into the portable storage medium by the writer of the money change machine, and the identification information of each storage cassette to which money has been sent from the money change machine in the collection process is read from the portable storage medium by the reader.

7. The money handling system according to claim 1, wherein the money change machine and the money handling machine are connected so as to be communicable with each other, the information on the number of the storage cassettes to which money has been sent from the money change machine in the collection process is transmitted from the money change machine to the money handling machine, and the controller is configured to determine whether or not money has been sent into the money handling machine from all of the storage cassettes to which money has been sent from the money change machine, based on the number of the storage cassettes mounted to the money handling machine, and the number of the storage cassettes to which money has been sent from the money change machine in the collection process, which is transmitted from the money change machine to the money handling machine.

8. The money handling system according to claim 7, wherein identification information of each storage cassette to which money has been sent from the money change machine in the collection process is also transmitted from the money change machine to the money handling machine.

9. The money handling system according to claim 1, wherein the controller is configured to output information on the storage cassette to which money has been sent from the money change machine and which has not sent money into the money handling machine when the collection process is interrupted.

10. The money handling system according to claim 1, wherein the money handling machine is configured to deposit therein the money collected from the money change machine by using the storage cassettes in one transaction which is the collection process performed at one time.

* * * * *